US006704523B2

(12) United States Patent
Takeuchi et al.

(10) Patent No.: US 6,704,523 B2
(45) Date of Patent: Mar. 9, 2004

(54) SHEET DETECTING APPARATUS AND IMAGE FORMING APPARATUS EQUIPPED WITH SHEET DETECTING APPARATUS

(75) Inventors: Ikuo Takeuchi, Ibaraki (JP); Kunio Tsuruno, Tokyo (JP); Tetsuya Morita, Kanagawa (JP); Keizo Isemura, Tokyo (JP); Ichiro Sasaki, Ibaraki (JP); Masahiro Kurahashi, Tokyo (JP); Atsushi Nakagawa, Ibaraki (JP); Kenji Fukushi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/201,991

(22) Filed: Jul. 25, 2002

(65) Prior Publication Data

US 2003/0031476 A1 Feb. 13, 2003

(30) Foreign Application Priority Data

Jul. 27, 2001 (JP) ..... 2001-227154
Jul. 27, 2001 (JP) ..... 2001-227155
Jul. 30, 2001 (JP) ..... 2001-229015

(51) Int. Cl.[7] ..... G03G 15/00; G03G 21/00

(52) U.S. Cl. ..... 399/16; 250/559.4; 399/9; 399/81

(58) Field of Search ..... 399/16, 18, 9, 399/38, 81, 361, 371, 388, 397; 271/258.01, 258.04, 265.01, 265.02; 356/614; 250/559.01, 559.29, 559.4

(56) References Cited

U.S. PATENT DOCUMENTS

| | | | | |
|---|---|---|---|---|
| 5,034,771 A | | 7/1991 | Makita | 399/21 |
| 5,828,924 A | * | 10/1998 | Fukada et al. | 399/16 |
| 6,348,697 B1 | * | 2/2002 | Kitajima | 250/559.4 |
| 2003/0007054 A1 | * | 1/2003 | Namiki et al. | 347/101 |
| 2003/0021608 A1 | * | 1/2003 | Morita et al. | 399/23 |

FOREIGN PATENT DOCUMENTS

| | | | |
|---|---|---|---|
| JP | 2-176766 | | 7/1990 |
| JP | 6-64789 | | 3/1994 |
| JP | 8-115013 | | 5/1996 |
| JP | 9-34309 | | 2/1997 |
| JP | 10-39556 | | 2/1998 |
| JP | 2001-063127 | * | 3/2001 |

* cited by examiner

*Primary Examiner*—Sophia S. Chen
(74) *Attorney, Agent, or Firm*—Fitzpatrick, Cella, Harper & Scinto

(57) ABSTRACT

The quantity of light of an optical sensor including a light emission portion and a light reception portion is adjusted through calculation before sheet detection is performed. In order to perform the light quantity adjustment, a voltage to be applied to the light emission portion of the optical sensor is obtained by performing calculation based on a relation between a voltage applied to the light emission portion before the adjustment and an output from the light reception portion before the adjustment. Then, it is judged whether the obtained voltage exists within a predetermined range and, if a positive result is obtained, the light quantity adjustment is ended. Further, a signal requesting the cleaning of the optical sensor is outputted in accordance with a value of the obtained voltage.

20 Claims, 18 Drawing Sheets

-- PRIOR ART --

-- PRIOR ART --

-- PRIOR ART --

SHEET DETECTING APPARATUS AND IMAGE FORMING APPARATUS EQUIPPED WITH SHEET DETECTING APPARATUS

BACKGROUND OF THE INVENTION

1. Field of the Invention

The present invention relates to a sheet detecting apparatus that detects the presence or absence of a sheet, and more specifically relates to a sheet detecting apparatus attached to a sheet conveying path of an image forming apparatus such as a copying machine or a printer.

2. Related Background Art

Conventional image forming apparatuses mainly adopt mechanical detection methods as sheet detecting means attached to their sheet conveying paths. As a representative example of the mechanical detecting methods, there has been used a method of a mechanical sensing lever type shown in FIG. 15. With the mechanical sensing lever type method, a lever 201 is arranged so as to block a sheet conveying path.

How the sheet detection of the mechanical sensing lever type is performed will be described. When a leading end portion 30 of a sheet passing through a sheet conveying path presses a part of the lever 201 and the lever 201 is rotated, the lever 201 cuts off a light flux of a photocoupler 202 arranged in proximity to the lever 201. Then, immediately after the sheet has passed therethrough, the lever 201 returns to its original position (indicated by a solid line) due to a force generated by a spring or the like.

When the light flux of the photocoupler 202 is cut off, there is generated a signal for detecting a sheet (there is not shown a signal generating portion). With the generated signal, it becomes possible to detect the presence or absence of a sheet.

However, there is exerted an influence of the counteraction of a spring or the like when the lever 201 returns to its original position, so that there occurs chattering. This chattering results in the increase of a time consumed to detect the trailing end of a sheet with precision. In particular, when a sheet is conveyed at high speed and with precision at constant intervals, it is required to detect the leading end and trailing end of the sheet with precision. As a result, the chattering exerts an enormous influence.

In order to detect the trailing end of the sheet with precision without receiving the influence of the chattering caused with the mechanical detection method, there has been used a detection method that uses an optical sensor. There have mainly been known two types of optical sensors: a reflection type optical sensor shown in FIGS. 16A and 16B and a transmission type optical sensor shown in FIG. 17.

The former reflection type optical sensor has a construction where a light emission element 2154 and a light reception element 2155 are placed on the same substrate and a reflection sheet 205 is affixed to a side opposite to the substrate with a conveying path therebetween, as shown in FIG. 16A. When a sheet 30 does not pass over an optical sensor, irradiation light of the light emission element 2154 is reflected by the reflection sheet and the reflection light is received by the light reception element 2155. While the sheet 30 is passing over the optical sensor, the irradiation light (reflection light) is cut off as shown in FIG. 16B, thereby detecting the sheet.

However, there is a case where erroneous detection is caused by the reflection from the sheet. In order to prevent the erroneous detection, it is required to take measures such as the improvement of the accuracy of the conveying position of each sheet to prevent variations of the position of each sheet or the employment of a condensing lens or the like.

The latter transmission type optical sensor has a construction where the light emission element 2154 and the light reception element 2155 are arranged at positions opposing to each other with the sheet conveying path therebetween, as shown in FIG. 17.

The presence of absence of a sheet is detected by the cutting off of the irradiation light 212 of the light emission element 2154 by the sheet 30. As a result, there occurs no erroneous detection due to the reflection from the sheet 30, but it is required to install the optical sensor with the high accuracy of relative positions on a light emission side and a light reception side.

In recent years, as a modification of the reflection type or transmission type optical sensor, there has been used an optical sensor shown in FIGS. 18A and 18B that combines the advantage of the reflection type with the advantage of the transmission type. This optical sensor has a construction where the light emission element 2154 and the light reception element 2155 are mounted on the same substrate 2152 and the axis of light irradiated from the light emission element 2154 and the axis of light received by the light reception element 2155 are set so as to be parallel through the refraction by a prism 2202 or the like. With this construction, it becomes possible to widen the allowable range of the installation accuracy concerning the light emission element 2154 and the light reception element 2155 and also to reduce the influence of the reflection of the sheet 30.

As shown in FIG. 18A, irradiation light from the light emission element 2154 is refracted twice by a prism 2202 at an incident angle of 45° to planes 2203 and 2204 and then is received by the light reception element 2155. While the sheet 30 is passing, the light is cut off and therefore the sheet 30 is detected (FIG. 18B).

In the case of a sheet detection method using an optical sensor, the brightness is increased in accordance with the increase of a current flowing to the light emission element 2154, so that it becomes possible to increase the dynamic range for the sheet detection and to improve the accuracy of the sheet detection. However, if a larger current than is necessary flows to the light emission element 2154, this leads to the reduction of a life span. In contrast to this, if the dynamic range of the optical sensor is set so as to be narrow in consideration of the reduction of the life span, there is increased the influence of stains on a sheet or the sensor, which means that there is a probability that erroneous detection is caused.

With the sheet detection method using an optical sensor, the adjustment of a light quantity of the optical sensor is an important problem. It is required to perform an appropriate initial adjustment when the optical sensor is installed. However, even if the initial adjustment is performed, a light emission portion or a light reception portion becomes dirty due to paper powder of a sheet, dusts adhering to the sheet, or the like, which means that it is required to perform the adjustment of a light quantity at regular intervals or at irregular intervals. As to the timings at which the light quantity adjustment is performed, the intervals between them are set in conformance with light quantity reduction degree due to the speed, specifications, use application, and the like of an image forming apparatus.

Here, a conventional method of adjusting the light quantity of an optical sensor will be described with reference to FIGS. 19A and 19B. FIG. 19A is a graph concerning the adjustment of a light quantity of an optical sensor that is carried out when an image forming apparatus is produced or when the optical sensor is replaced by a serviceman.

The reference symbol Vin represents an application voltage applied to a light emission element of an optical sensor. The reference symbol Vout represents an output voltage obtained by converting the quantity of light received by the light reception element of the optical sensor. When a predetermined voltage is applied to the light emission element of the optical sensor, the light reception element outputs a voltage through a voltage conversion circuit. If the output voltage obtained as a result of this operation is equal to or higher than a preset threshold value Vh, the value is set as a control voltage and the light quantity adjustment is ended.

When there is applied Vin1, an output voltage becomes equal to or higher than the threshold value Vh like in the case of A1 shown in FIG. 19A. Therefore, it is judged that the light quantity adjustment is not required and the adjustment is ended. The threshold value Vh is an output voltage that does not cause any problem concerning the sheet detection even in consideration of the reduction of a light quantity due to the stains on the optical sensor or the life span thereof. This value is set in advance in accordance with the characteristics of the image forming apparatus.

If the output voltage does not reach the threshold value Vh when Vin1 is applied like in the case of B1, the application voltage is gradually increased from Vin1 until there is obtained an output voltage that is at least equal to Vh. Following this, when the output voltage becomes at least equal to Vh, the application voltage (Vin2) is set as the control voltage and the light quantity adjustment is ended.

In the case of C1, like in the case of B1, the application voltage is gradually increased until there is obtained the output voltage that is at least equal to the threshold value Vh. However, if the output voltage does not become at least equal to the threshold value Vh even if, as in the case of C2, the application voltage is increased until VinMAX that is the upper limit value of the application voltage, it is judged that the optical sensor is a defective part.

FIG. 19B is a graph concerning the adjustment of a light quantity of an optical sensor that is performed between jobs like copy jobs or when the power source of an image forming apparatus is turned on.

As shown in FIG. 19B, the light quantity adjustment is performed when the light quantity of the optical sensor is decreased from A1 to A2. The application voltage Vin applied to the optical sensor is increased from Vin1, thereby setting the output voltage at the threshold value Vh or higher. A Vin value (A3) obtained when the output voltage reaches the threshold value is set as the control voltage and the light quantity adjustment is ended.

In a like manner, when the light quantity of the optical sensor is decreased from B2 to B3, the light quantity adjustment is performed. When the output voltage does not become at least equal to the threshold value Vh even if the application voltage applied to the optical sensor is increased to the upper limit value Vin MAX, VinMAX (B4) is set as the control voltage and the light quantity adjustment is ended. It is possible for the optical sensor to perform the sheet detection even if the control voltage is set at VinMAX, although it becomes impossible to perform the sheet detection if the light quantity is decreased to a limit value VS.

There has been avoided the use of the conventional optical sensor at a location where there is easily exerted the influence of paper powder of a sheet or at a location where there is easily exerted the influence of a use environment, so that it has been enough for the judgment of the presence or absence of a sheet that a certain degree of dynamic range is maintained. In addition, by frequently performing the light quantity adjustment between a copy job and another copy job, it becomes possible to perform the adjustment before the light quantity of the optical sensor is significantly decreased. As a result, it has been possible to complete the adjustment in a short time.

However, depending on the performance or use environment of the image forming apparatus, the decreasing degree of the light quantity of the optical sensor becomes considerable, so that it is required to maintain a sufficient dynamic range of an optical sensor. In addition, in an image forming apparatus that is capable of conveying a sheet at high speed, there are performed job copying large quantity of sheets. As a result, the decreasing degree of the light quantity of the optical sensor for one copy job is increased.

If a conventional light quantity adjustment method is adopted under such a circumstance, there is exerted an influence on a time consumed to end the light quantity adjustment. This is because the decreasing degree of the light quantity of an optical sensor is increased and therefore the range of a voltage applied during the light quantity adjustment is increased.

Further, if the decreasing degree of the light quantity of the optical sensor is large, it becomes impossible to perform the sheet detection at a relatively early stage. As a result, an image forming apparatus falls into an inoperable state. In this state, it becomes completely impossible to perform image formation and therefore a user feels dissatisfaction.

SUMMARY OF THE INVENTION

An object of the present invention is to provide a sheet detecting apparatus and an image forming apparatus equipped with the sheet detecting apparatus, where the sheet detecting apparatus is capable of performing the most suitable light quantity adjustment under a condition where the quantity of light of an optical sensor is considerably reduced.

Another object of the present invention is to provide a sheet detecting apparatus and an image forming apparatus equipped with the sheet detecting apparatus, where the sheet detecting apparatus is capable of, before it becomes impossible to perform sheet detection, sending a notification to a user, a serviceman, or administrator by displaying the state of an optical sensor.

Still another object of the present invention is to provide a sheet detecting apparatus and an image forming apparatus equipped with the sheet detecting apparatus, where the sheet detecting apparatus is capable of circumventing, as much as possible, a situation where it becomes impossible to perform sheet detection and the image forming apparatus falls into an inoperable state.

Therefore, according to the present invention, there is provided a sheet detecting apparatus, characterized by comprising an optical sensor including a light emission portion and a light reception portion, judging means for judging the presence or absence of a sheet by applying a voltage to the light emission portion adjusting means for adjusting the voltage to be applied to the light emission portion in order to make the judgment, and calculating means for obtaining the voltage to be applied to the light emission portion at the adjusting means through calculation.

Also, according to the present invention, in the sheet detecting apparatus, it is characterized in that when adjusting the voltage to be applied to the light emission portion, the calculating means obtains the voltage to be applied to the light emission portion through calculation based on a relation between a voltage applied to the light emission portion before the adjustment and an output obtained through reception of light from the light emission portion by the light reception portion before the adjustment.

Also, according to the present invention, in the sheet detecting apparatus, it is characterized in that a state of the optical sensor is displayed in accordance with a fact that the voltage obtained by the calculating means is equal to or higher than the maximum value of a voltage applicable to the light emission portion.

Also, according to the present invention, in the sheet detecting apparatus, it is characterized in that the sheet detecting apparatus comprises communication means for communicating with an external apparatus, and that a notification is sent to the external apparatus through the communication means in accordance with a fact that the voltage obtained by the calculating means is equal to or higher than the maximum value of a voltage applicable to the light emission portion.

Also, according to the present invention, in the sheet detecting apparatus, it is characterized in that the adjusting means includes first means for adjusting the voltage to be applied to the light emission portion based on the calculating means and second means for adjusting the voltage to be applied to the light emission portion in accordance with a fact that a predetermined condition is satisfied by an output obtained through reception of light emitted by the light emission portion through gradual application of a voltage, by means of the light reception portion.

Also, according to the present invention, there is provided an image forming apparatus, characterized by comprising a conveying path for conveying a sheet, an optical sensor including a light emission portion and a light reception portion, for detecting a sheet passing through the sheet conveying path, judging means for judging the presence or absence of a sheet by applying a voltage to the light emission portion, adjusting means for adjusting the voltage to be applied to the light emission portion in order to make the judgment, calculating means for obtaining the voltage to be adjusted by the adjusting means through calculation, and control means for controlling conveyance of a sheet by applying the voltage obtained by the calculating means to the light emission portion and by detecting the sheet.

Also, according to the present invention, in the image forming apparatus, characterized in that when adjusting the voltage to be applied to the light emission portion, the calculating means obtains the voltage to be applied to the light emission portion through calculation based on a relation between a voltage applied to the light emission portion before the adjustment and an output obtained through reception of light from the light emission portion by the light reception portion before the adjustment.

Also, according to the present invention, in the image forming apparatus, characterized in that a state of the optical sensor is displayed in accordance with a fact that the voltage obtained by the calculating means is at least equal to the maximum value of a voltage applicable to the light emission portion.

Also, according to the present invention, in the image forming apparatus, it is characterized in that the image forming apparatus further comprises communication means for communicating with an external apparatus, and that a notification is sent to the external apparatus through the communication means in accordance with a fact that the voltage obtained by the calculating means is equal to or higher than the maximum value of a voltage applicable to the light emission portion.

Also, according to the present invention, in the image forming apparatus, it is characterized in that if an output from the light reception portion through the application of the voltage obtained by the calculating means to the light emission portion is equal to or lower than a predetermined value, it is judged that the optical sensor suffers from an abnormality and there is inhibited setting involving use of the sheet conveying path, in which the optical sensor is provided, without inhibiting use of the whole of the image forming apparatus.

Also, according to the present invention, in the image forming apparatus, it is characterized in that an item, whose setting for usage is inhibited, is displayed so as to be distinguishable from each item whose setting is possible, and that setting is not received even if a portion corresponding to the item, whose setting is inhibited, is pushed.

Also, according to the present invention, in the image forming apparatus, it is characterized in that the adjusting means includes: first means for adjusting the voltage to be applied to the light emission portion based on the calculating means, and second means for adjusting the voltage to be applied to the light emission portion in accordance with a fact that a predetermined condition is satisfied by an output obtained through reception of light emitted by the light emission portion emit light through gradual application of a voltage, by means of the light reception portion.

The stated objects and effects of the present invention and other objects and effects thereof will become apparent from description to be made with reference to the following drawings.

DETAILED DESCRIPTION OF THE PREFERRED EMBODIMENTS

Figure 1:
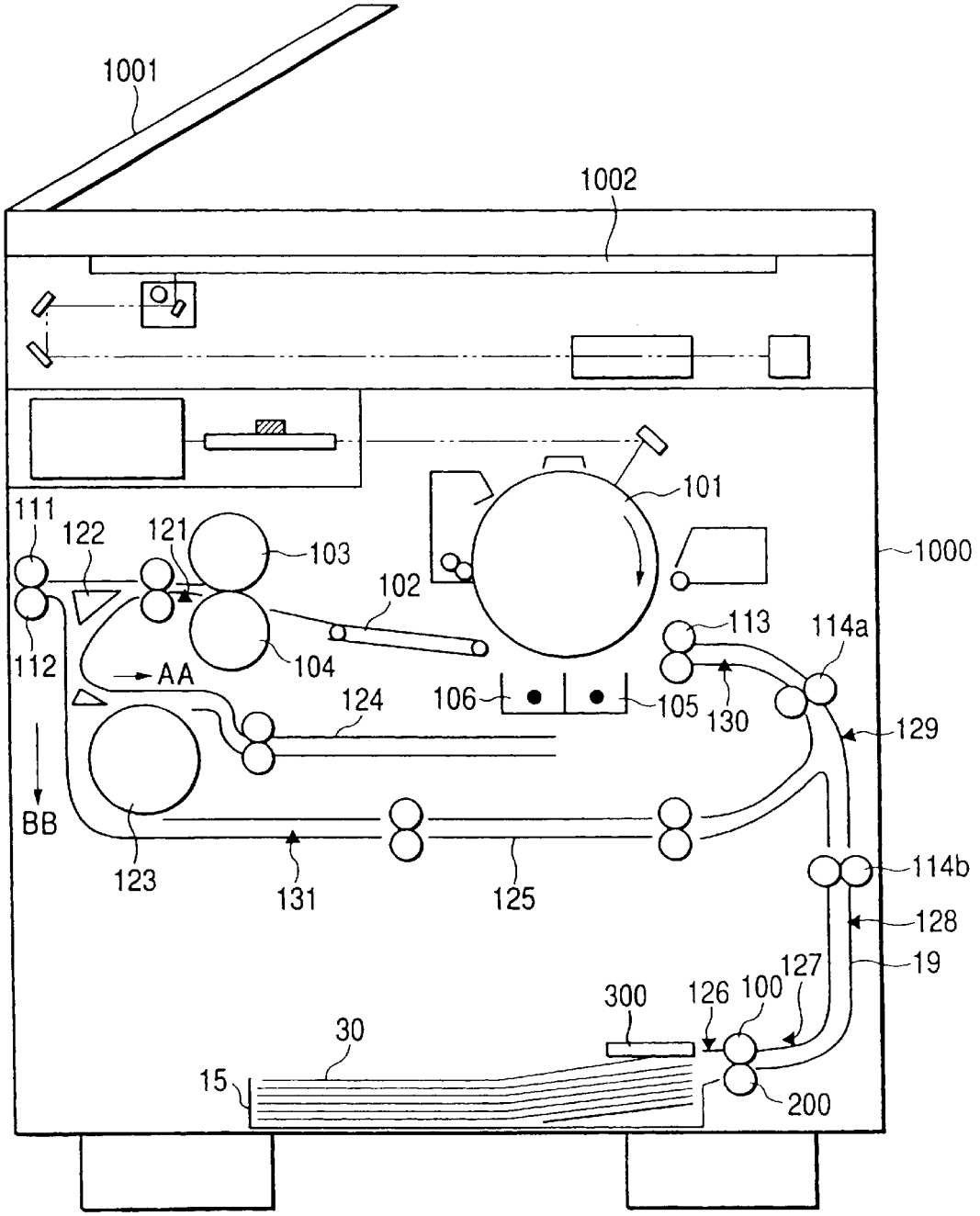
FIG. 1 is a construction drawing of an image forming apparatus.

An embodiment of the present invention will be described in detail. FIG. 1 is a construction drawing in which a sheet detection apparatus having an optical sensor is applied to a sheet conveying path of an image forming apparatus.

In FIG. 1, reference numeral 1000 denotes a main body of the image forming apparatus. Reference numeral 1001 indicates an automatic original conveying apparatus (or auto-feeding device) that conveys an original to an exposing position and numeral 1002 represents an original base glass (or glass plate) functioning as an original placing means. Reference numeral 15 denotes a sheet feeding cassette in which sheets 30 are stacked. The sheets 30 are mainly paper, although they may be OHP films for an overhead projector depending on which apparatus is used. Although not shown in FIG. 1, the image forming apparatus includes a display unit for displaying image forming conditions, errors, and the like and is further provided with a display control portion that controls the display unit.

Here, the control of sheet conveying will be described. The control of respective kinds of rollers for conveying the sheets is performed by a control portion within the image forming apparatus. When the sheets 30 stacked on the sheet feeding cassette 15 are sent out by a pickup roller 300, the sheets 30 are separately picked up one by one by separation and feed rollers 100 and 200 and are sent out to a conveying path 19. Further, the sheets 30 are conveyed to a registration roller 113 by each convey roller 114*a*, 114*b*. The operation of the registration roller 113 is started in the case where conditions concerning an optical system and the like are satisfied. Images obtained by developing latent images on a photosensitive body 101 are transferred on the sheets 30 by a transferring portion 105. Then, the sheets 30 are separated by a separation portion 106 so as not to be wound around the photosensitive body 101 and are sent to a convey belt 102. Following this, the sheets 30 are conveyed to a nip portion between a fixing roller 103 and a pressurizing roller 104 for fixation and are discharged to the outside of the apparatus by discharging rollers 111 and 112.

In the case where image formation is performed for both surfaces (or sides) of a sheet, the sheet 30 is not discharged to the outside of the apparatus but is sent to a duplex conveying unit existing at a lower position by a flapper 122. The sheet 30 is sent in the AA direction by the rotation of a reverse roller 123 and reaches a reversal position 124. After the sheet 30 reaches the reversal position 124, the sheet 30 is conveyed in the BB direction by the backward rotation of a reversal roller 123. The sheet 30 passes through a duplex conveying path 125 and is conveyed to the registration roller 113. Then, an image is formed on the rear surface of the sheet 30 and the sheet 30 passes through the conveying path and is discharged to the outside of the apparatus.

At midpoints of the conveying path, there are arranged optical sensors 121, 126, 127, 128, 129, 130, and 131. These optical sensors detect the sheets 30 and judge the presence or absence of the sheets. On the basis of a result of this judgment, the control portion in the image forming apparatus performs control so that the sheet conveying is normally performed.

Figure 18A:
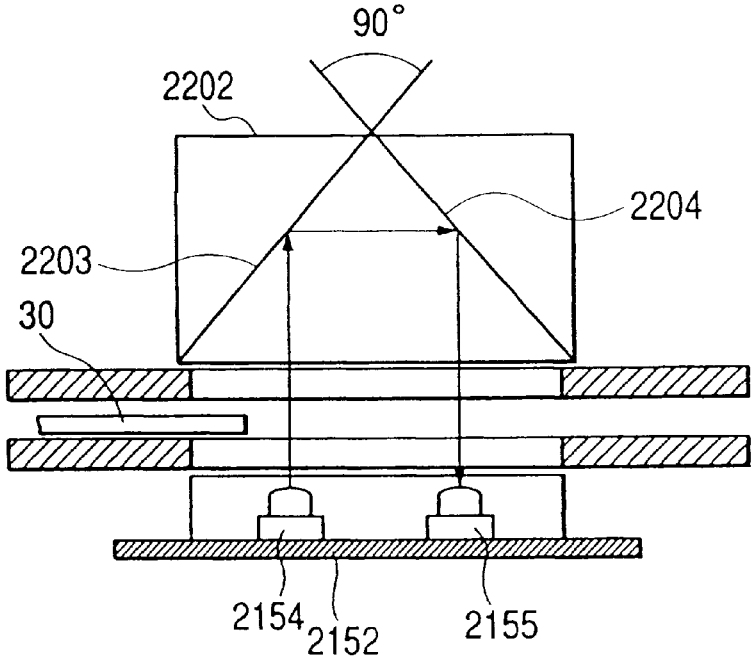
FIGS. 18A and 18B are each a construction drawing of an optical sensor that combines the advantage of the reflection type optical sensor with the advantage of the transmission type optical sensor.
Figure 18B:
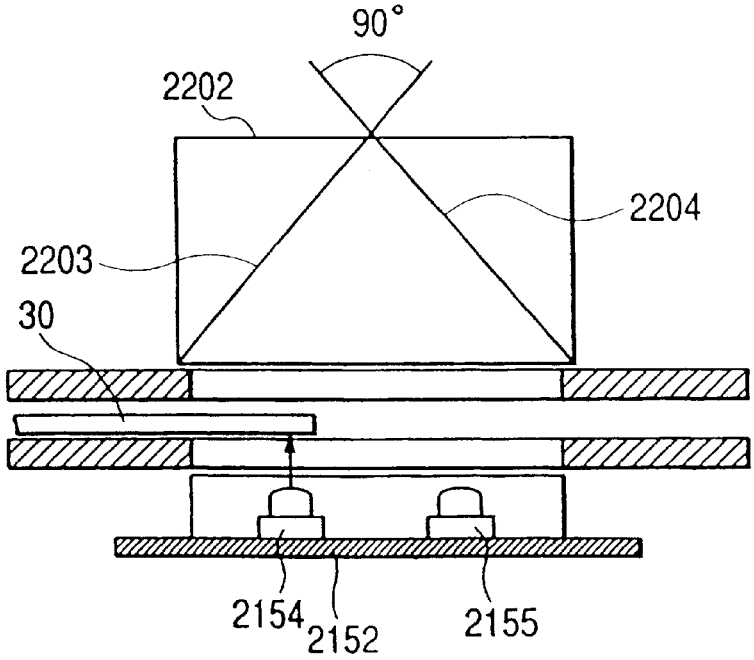
Figure 19A:
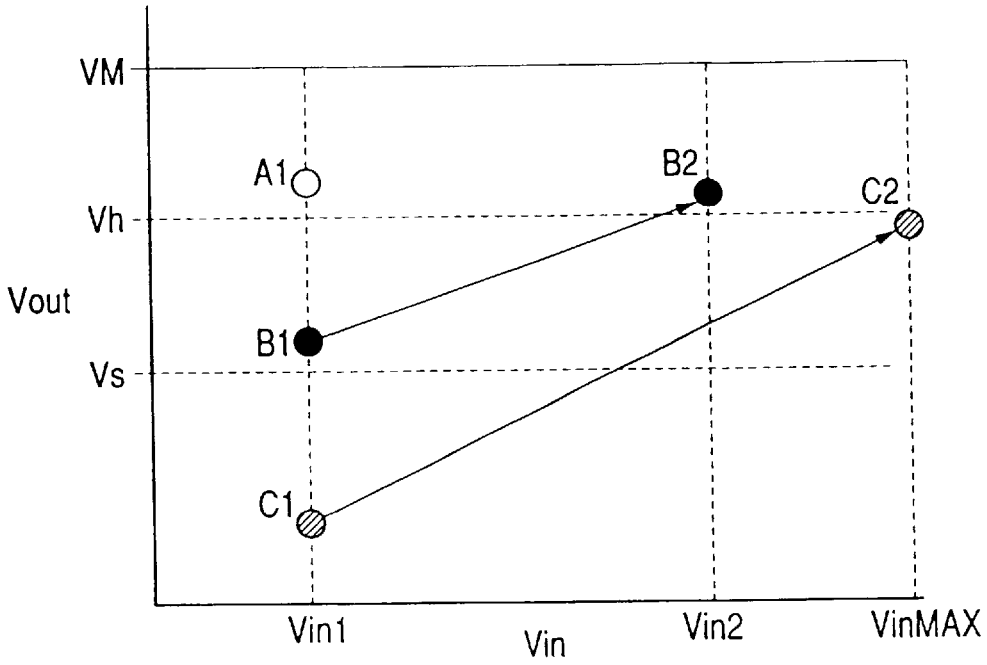
FIGS. 19A and 19B are each a graph showing an input-output characteristic curve in the case where conventional light quantity adjustment is performed with an optical sensor.
Figure 19B:
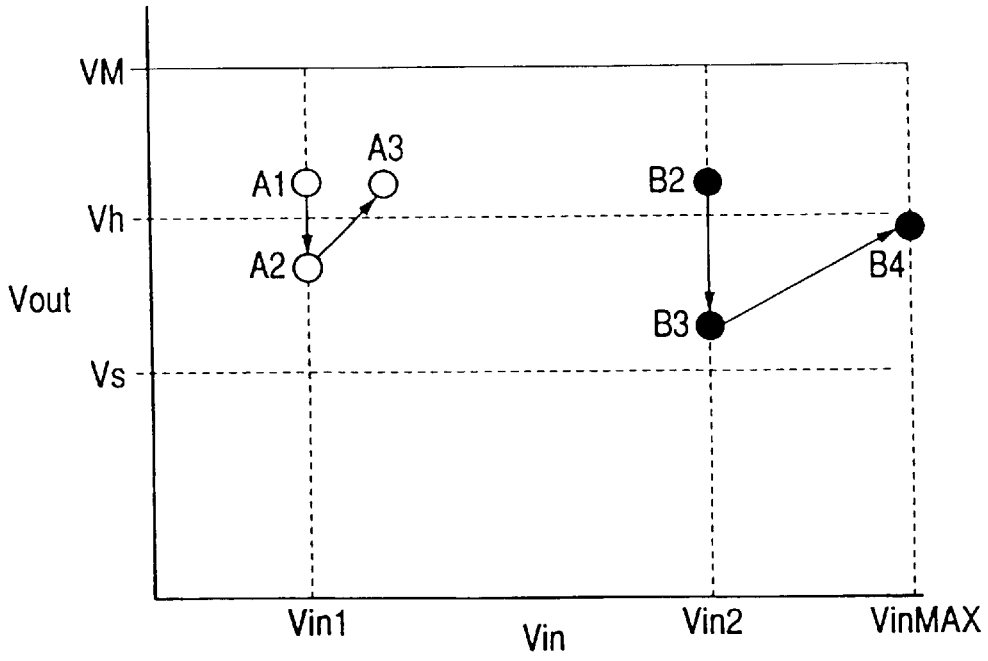
Figure 13:
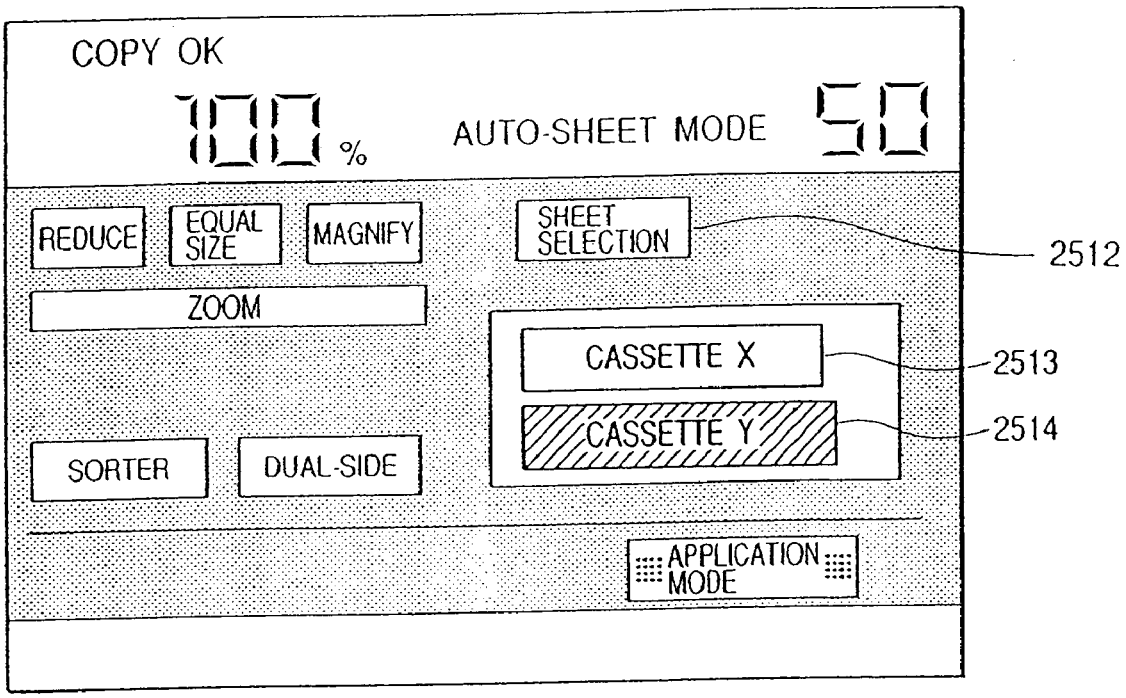

As shown in FIGS. 16A, 16B, 17, 18A, and 18B, there are several kinds of optical sensors, although the following description will be made using an optical sensor shown in FIGS. 18A and 18B in this embodiment. Note that the present invention is not limited to the optical sensor shown in FIGS. 18A and 18B.

Figure 2:
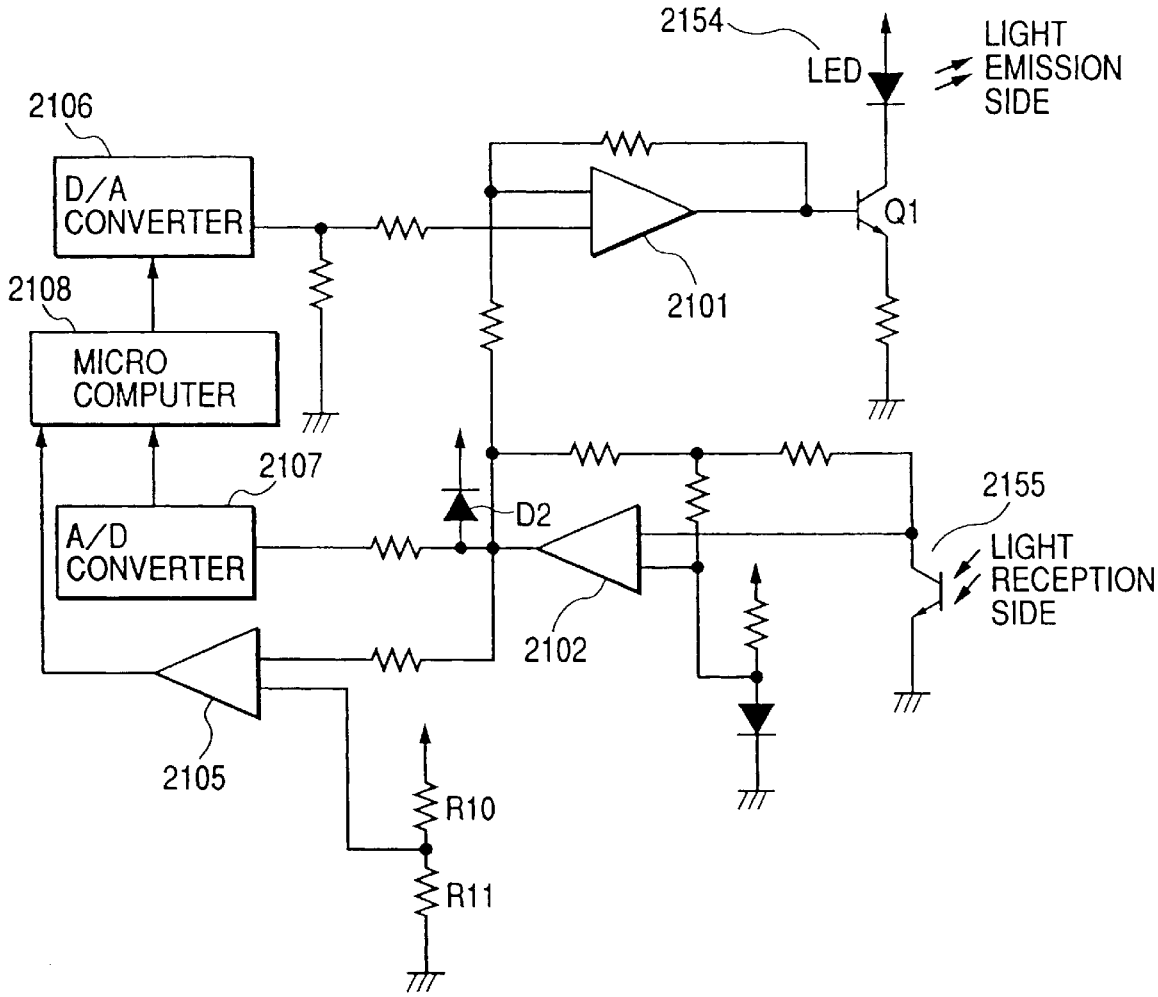
FIG. 2 is a drawing showing a drive circuit for adjusting the quantity of light of an optical sensor.

The sheet detection by the optical sensor will be described in detail with reference to FIG. 2. FIG. 2 shows a driver circuit for driving the optical sensor. A predetermined digital signal is sent from a microcomputer 2108 to a D/A converter 2106. The D/A converter 2106 converts the digital signal of the microcomputer 2108 into a voltage. This voltage is converted by an operational amplifier 2101 into a constant current for driving an LED 2154. Then, a transistor Q1 is turned on to cause the LED 2154 to emit light with a predetermined current. Irradiation light emitted is received by a light reception element 2155 through a prism 2202 as shown in FIGS. 18A and 18B.

The light reception element 2155 is a photodiode and a current flows thereto when this element receives light having a predetermined wavelength. An operational amplifier 2102 amplifies an output voltage so as to regulate the current flowing to the photodiode to be constant. Note that the output amplified by the operational amplifier 2102 is separately sent to an A/D converter 2107 and a comparator 2105.

When the light quantity adjustment is performed, the microcomputer 2108 outputs the digital signal to the D/A converter 2106 and monitors the output from the operational amplifier 2102. Then, the microcomputer 2108 controls the digital signal to the D/A converter 2106 so that there is obtained an output that is optimum for the judgment of the presence or absence of a sheet at the comparator 2105.

The output from the operational amplifier 2102 after the light quantity adjustment is performed is converted by the comparator 2105 into binary data having H and L levels with reference to predetermined voltages set by R10 and R11. The binary data is sent to the microcomputer 2108. Then, the microcomputer 2108 judges the presence or absence of a sheet.

For instance, when a sheet does not pass over the optical sensor, the irradiation light is received by the light reception element 2155 through the prism 2202 and there is outputted a voltage that is at least equal to or higher than a reference value. The H level is obtained at the comparator 2105 and the microcomputer 2108 judges that there exists no sheet. On the other hand, when a sheet passes over the optical sensor, the irradiation light is cut off by the sheet and therefore no current flows to the light reception element 2155. As a result, it becomes impossible to obtain an output voltage. The L level is obtained at the comparator 2105 and the microcomputer 2108 judges that there exists a sheet.

The above description has been made on the assumption that the D/A converter 2106 and the A/D converter 2107 are separated from the microcomputer 2108. However, the D/A converter 2106 and the A/D converter 2107 may be embedded in the microcomputer 2108. Also, there has been described a case where binary data is obtained using the comparator 2105 and the judgment concerning the presence or absence of a sheet is performed. However, the judgment concerning the presence or absence of a sheet may be performed using an output from the A/D converter 2107.

Figure 3A:
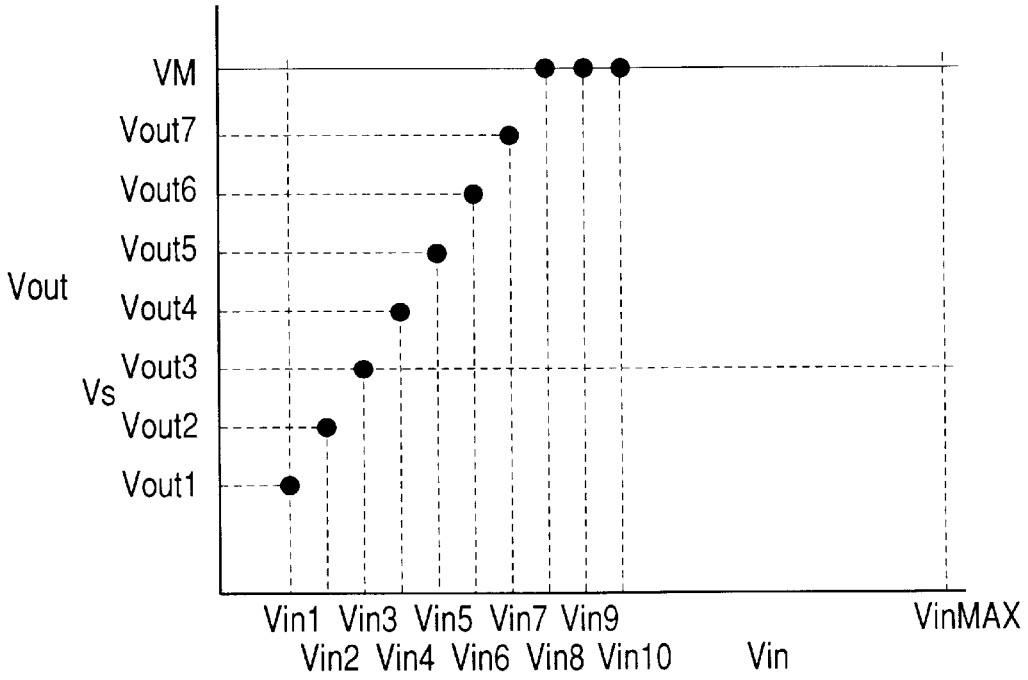
FIGS. 3A and 3B are each a graph showing an input-output characteristic curve in the case where light quantity adjustment is performed for the optical sensor.
Figure 3B:
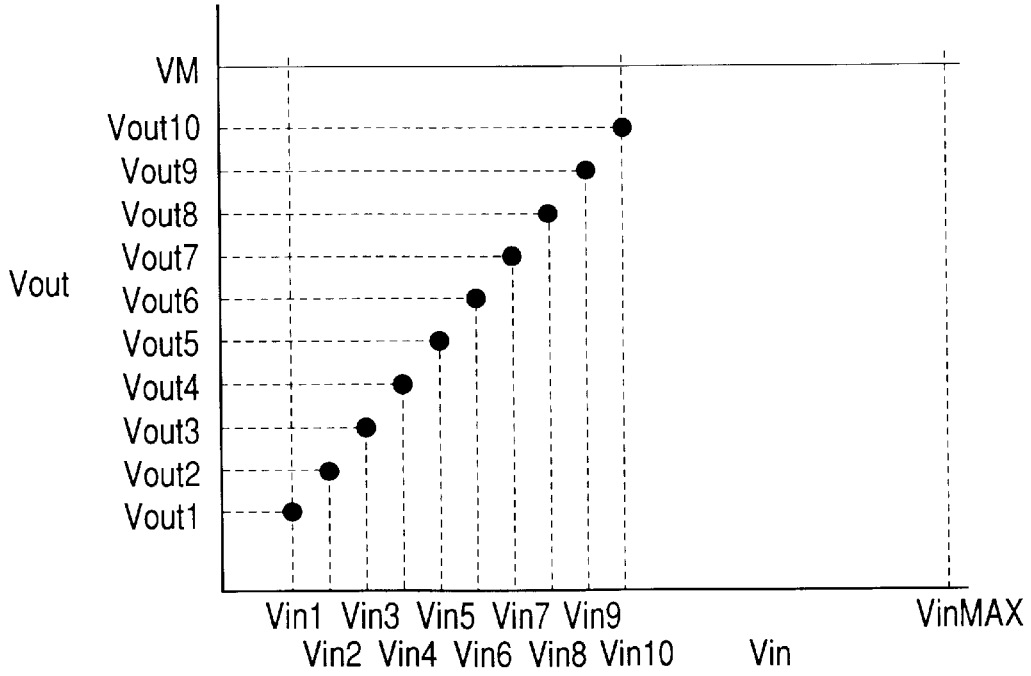

Here, a relation between a voltage (Vin) applied to the light emission portion of the optical sensor and an output voltage (Vout) obtained by converting the quantity of light received by the light reception portion is shown in FIGS. 3A and 3B. FIGS. 3A and 3B are each a graph showing a Vin-Vout characteristic curve. As can be seen from these drawings, the relation between Vin and Vout is inclined in a straight manner until there is obtained a predetermined output voltage. The reference symbol Vin represents an application voltage applied to the light emission element of the optical sensor and the reference symbol Vout represents an output voltage obtained by converting the quantity of light received by the light reception element of the optical sensor. When Vin1 is applied to the light emission element, the light reception element outputs Vout1 through a voltage conversion circuit. Further, when there is applied Vin2 having a relation of Vin2>Vin1, Vout2 is outputted. In a like manner, when a voltage is applied so that a relation of Vin(N+1)>VinN is maintained, the increase of the application voltage results in the direct increase of a light quantity. There is also increased an output voltage.

In order to protect the control portion including the microcomputer 2108, the A/D converter 2107, and the like, there is prevented a situation where the output voltage exceeds a certain level, using a diode cramp or the like comprising a diode D2.

The image forming apparatus has two methods of adjusting the quantity of light of an optical sensor. One of the two methods is the light quantity adjustment performed when the image forming apparatus is produced at a plant or when the optical sensor is installed or replaced by a serviceman or the like. In this case, it is required that the adjustment is performed with high precision to realize a situation where a long maintenance free period of the optical sensor is held. The other of the two methods is the light quantity adjustment performed when the power source of the image forming apparatus is turned on or between jobs such as copying. In this case, it is required that the adjustment is performed in a short time so that there is exerted no influence on the operation of the image forming apparatus. The image forming apparatus has the two light quantity adjustment methods, so that it is possible to perform the light quantity adjustment with high precision during the initial adjustment and to appropriately perform light quantity adjustment following the initial adjustment in a short time even in the case where the light quantity is significantly reduced.

Figure 4:
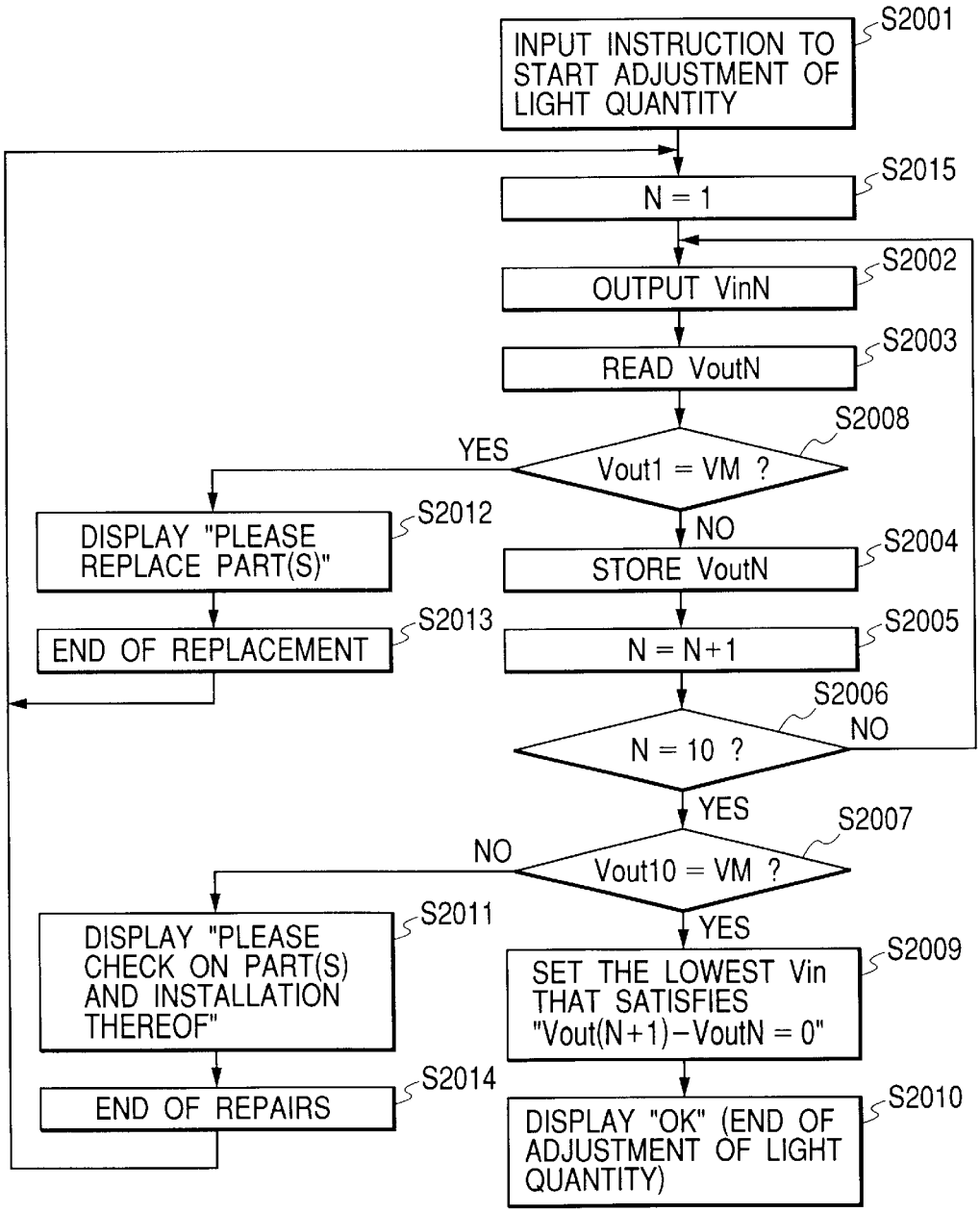
FIG. 4 is a flowchart concerning light quantity adjustment performed when the image forming apparatus is produced or when the optical sensor is installed or replaced.

First, there will be described the light quantity adjustment method performed when the image forming apparatus in FIG. 4 is produced or when the optical sensor is installed or replaced. The following description will be made by also using the driver circuit of the optical sensor shown in FIG. 2 and the graphs showing the Vin-Vout characteristic curve in FIGS. 3A and 3B.

In step S2001, an instruction to start the adjustment of a light quantity is input after the installation of the optical sensor is completed. It does not matter whether the light quantity adjustment is started by an input from an operation unit of the image forming apparatus or is automatically started when the power source is turned on. In step S2015, a counter N of the microcomputer 2108 is reset to "1". In step S2002, a predetermined digital signal corresponding to VinN is output from the microcomputer 2108, thereby causing the LED 2154 to emit light. A voltage applied to the light emission element 2154 to start the light quantity adjustment is Vin1. The value of Vin1 shown in FIGS. 3A and 3B is a value regulated by the maximum value of variations of the quantity of light of the optical sensor.

In step S2003, the quantity of light received by the light reception element 2155 is converted into a voltage value (VoutN) and the microcomputer 2108 reads this value. In step S2008, the microcomputer 2108 judges whether Vout1 obtained from Vin1 reaches VM. Here, VM is the maximum value that the driver circuit of the optical sensor is capable of outputting.

Figure 6A:
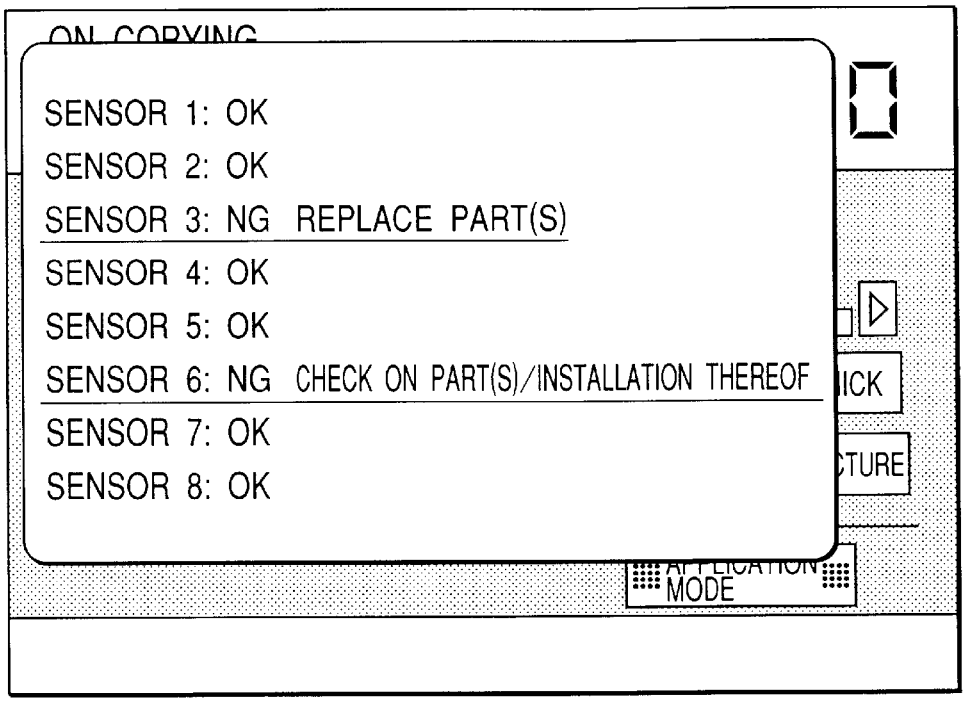
FIGS. 6A and 6B are each a drawing showing a display unit of an operation unit of the image forming apparatus.
Figure 6B:
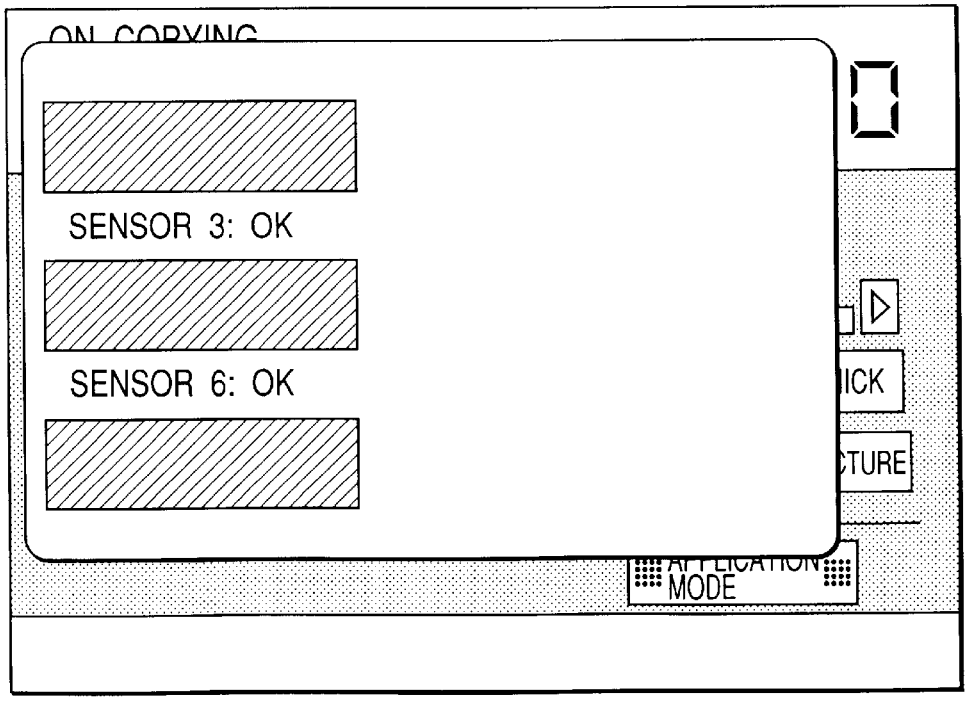

If a "YES" result is obtained in step S2008, an "NG" judgment is made. The quantity of light of the optical sensor is too large (the LED is too bright), so that there is exerted the influence of a sheet and components may be damaged. Note that if the "NG" judgment is made in this step, a message like "PLEASE REPLACE PART(S)" is displayed on the display unit of the image forming apparatus (step S2012), and the replacement is completed (step S2013). FIGS. 6A and 6B are each a drawing showing the display unit of the image forming apparatus. The screen in FIG. 6A shows a state where parts of the optical sensor 3 need replacement.

On the other hand, if Vin1 does not reach VM (a "NO" judgment is made) in step S2008, the processing proceeds to step S2004. In step S2004, the value of the output voltage is stored in a memory portion of the microcomputer 2108. For instance, when there is inputted Vin1, there is stored the value of Vout1 (FIGS. 3A and 3B). It is not required that the storing portion of the microcomputer 2108 is provided within the microcomputer but the storing portion may be an accessible external element.

In step S2005, a value "1" is added to the numeric value of the counter N in the microcomputer 2108. In step S2006, it is judged whether output/input operations have been performed ten times that is the number of repetition preset by the microcomputer 2108. FIGS. 3A and 3B are each graphs where the number of repetitions is set at ten until there is applied Vin10. However, the number of repetitions is obtained by dividing a signal output from the microcomputer within a certain range in advance and it is possible to freely set the number of divisions at 8, 16, or the like. Note that although the accuracy is improved in accordance with the increase of the number of repetition, a time consumed is elongated.

Vin10 shown in FIGS. 3A and 3B is the minimum value among values that are allowable in view of mechanical specifications and it is required to set this value in accordance with the specifications. Note that by setting Vin10 at a somewhat small value, there is widened the width of light quantity adjustment which gets to an application voltage that is a standard of the life span of the optical sensor and it becomes possible to elongate the intervals between maintenance works for the optical sensor.

If a "NO" result is obtained in step S2006, the processing returns to step S2002 again and a predetermined digital signal is output from the microcomputer 2108.

If the routine from step S2002 to step S2006 has been repeated ten times, the processing proceeds to step S2007. In step S2007, the microcomputer 2108 judges whether the output voltage reaches VM. If the output voltage reaches VM, the processing proceeds to step S2009. In step S2009, the microcomputer 2108 sets the lowest value of Vin obtained when a changing amount becomes zero between Vout1 and Vout10. The Vin value set in this manner represents a voltage applied to an optical element of the optical sensor and is used to obtain the quantity of light of the optical sensor that is required to perform the sheet detection. In step S2010, a display control portion that controls the contents displayed on the display unit of the image forming apparatus displays a screen showing that the adjustment of the quantity of light of the optical sensor is ended. Referring to FIG. 3A, the output voltage reaches VM when Vin8 is input. Even if a voltage exceeding Vin8 is applied, there is obtained VM, that is, the changing amount of the output voltage becomes zero. That is, the optical sensor sufficiently functions if Vin8 is applied.

On the other hand, in the case where the output voltage does not reach VM (in the case of a "NO" result) in step S2007, an "NG" judgment is made. In step S2011, an NG message like "PLEASE CHECK ON PART(S) AND INSTALLATION THEREOF" is displayed on the display unit. FIGS. 6A and 6B each shows the display unit of the image forming apparatus. The screen shown in FIG. 6A shows a state where the NG judgment has been made for the optical sensor 6 and it is required to check the parts or the installation thereof. When this screen is displayed, there is a high probability that stains adhere to the optical sensor, the installation has been incorrectly performed, or any parts are damaged.

In steps S2013 and S2014, when the replacement of parts of the optical sensor or the check of the installation and adjustment thereof is ended, respectively, the light quantity adjustment from step S2015 is started again. If the adjustment of the quantity of light of the optical sensor has been normally performed, the display control portion of the image forming apparatus changes to the displayed screen shown in FIG. 6B.

Figure 5:
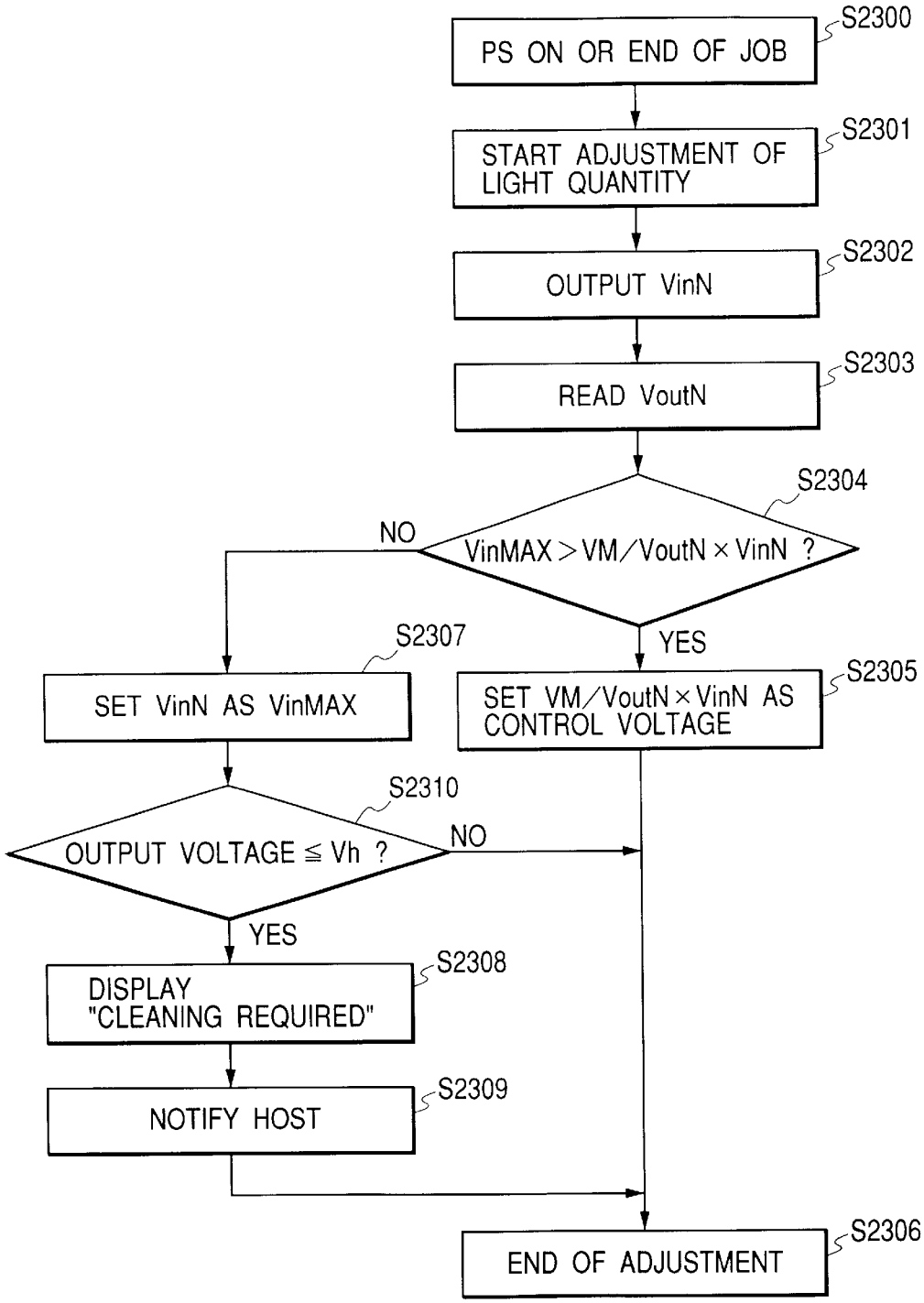
FIG. 5 is a flowchart concerning light quantity adjustment performed when the power source of the image forming apparatus is turned on or between jobs such as copying.

Next, there will be described the method of performing the light quantity adjustment performed when the power source of the image forming apparatus in FIG. 5 is turned on or between jobs such as copying. The following description will be made by also referring to the driver circuit of an optical sensor shown in FIG. 2 and the graph of the Vin-Vout characteristic curves in FIGS. 3A and 3B. This adjustment method is a method that becomes effective when it becomes necessary to adjust the light quantity due to the stains on the optical sensors, the degradation thereof, and the like after a user starts to use the image forming apparatus. Note that the stains on the optical sensors are conspicuous for the optical sensors existing in the vicinity of a sheet feeding cassette. This is because paper powder of sheets, dusts adhering to the sheets, or the like tend to drop when the sheets are sent out from the sheet feeding cassette.

In step S2300, when the power source of the image forming apparatus is turned on or when the end of a predetermined number of jobs is detected, the processing proceeds to step S2301. In step S2301, the microcomputer 2108 makes a judgment concerning predetermined conditions and automatically starts the light quantity adjustment for the optical sensor. In step S2302, if the microcomputer 2108 outputs a predetermined digital signal corresponding to VinN, the LED 2154 emits light. In step S2303, the quantity of light received by the light reception element 2155 is converted into a voltage value and the microcomputer 2108 reads VoutN.

In step S2304, there is obtained a voltage applied to the light emission element 2154 in order to compensate for the decreasing amount of light due to the stains on the optical sensors or the like. Then, the microcomputer 2108 judges whether the voltage obtained reaches the preset maximum value (VinMAX) of the application voltage.

How the voltage to be applied to the light emission element 2154 of the optical sensor is obtained in step S2304 will be described. Here, it is assumed that after the initial adjustment of the optical sensor is already performed, the quantity of light of the optical sensor is decreased and therefore the light quantity adjustment is performed for the optical sensor. During this light quantity adjustment, there is obtained a voltage to be applied to the light emission element 2154 in order to compensate only for the decreasing amount of the light quantity of the optical sensor. In the case of an optical sensor whose Vin and Vout have the relation shown in FIG. 3A or 3B, the voltage to be applied to the light emission element 2154 is generally and schematically obtained from the following numerical formula.

$$VM/VoutN \times VinN$$

In step S2304, the microcomputer 2018 judges whether the voltage to be applied to the light emission element 2154 obtained from this formula reaches the preset VinMAX.

Figure 8:
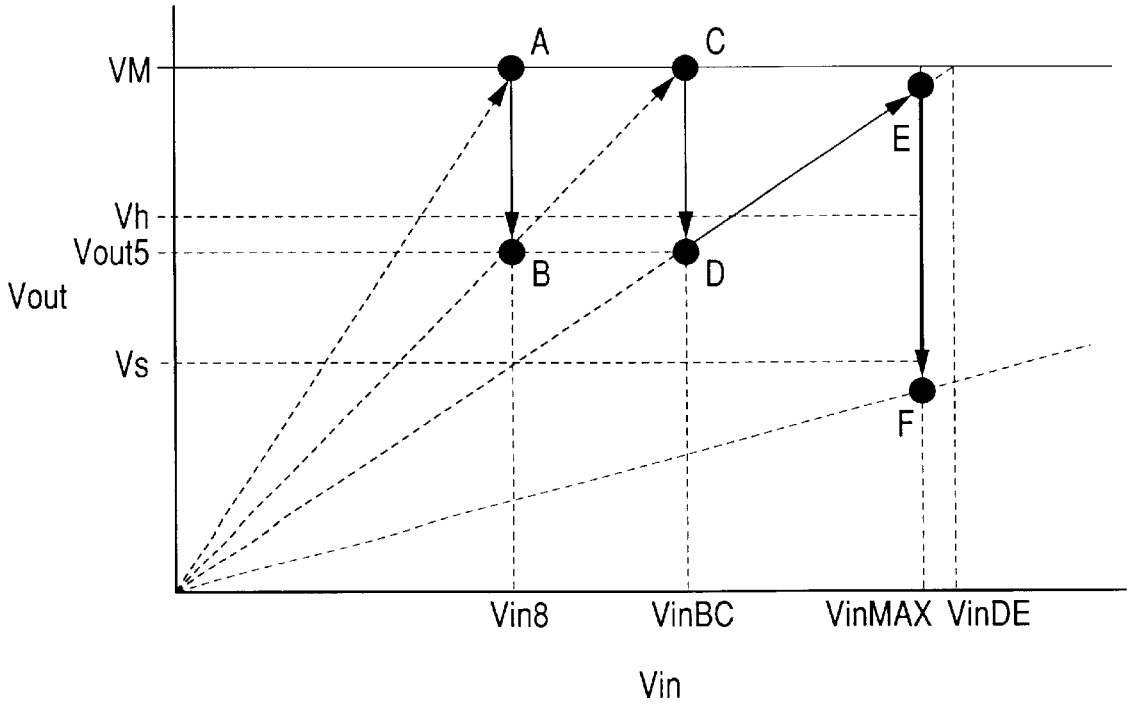
FIG. 8 is a graph showing an input-output characteristic curve in the case where the light quantity adjustment is performed for the optical sensor.

If the judgment result in step S2304 is "YES", the processing proceeds to step S2305. A state, for which the "YES" result is obtained in step S2304, will be concretely described with reference to FIG. 8. Here, it is assumed that when the light quantity of the optical sensor decreases from "A" to "B" as shown in FIG. 8, the light quantity adjustment is performed. A voltage VinN applied to the light emission element 2154 when the light quantity is "B" is Vin8 and the output voltage VoutN obtained by converting the quantity of light received by the light reception element 2155 is Vout5. The voltage VinBC applied to the light emission element 2154 for compensating only for the decreasing amount of the light quantity of the optical sensor is obtained by "VinBC=VM/Vout5×Vin8" as a result of the light quantity adjustment at "B". The obtained voltage VinBC has a relation of VinMAX>VinBC, so that the processing proceeds to step S2305.

In step S2305, the obtained voltage VinBC is set as a voltage value for controlling the light quantity of the optical sensor and there is obtained a light quantity corresponding to the set voltage. Then, the light quantity adjustment is ended in step S2306. After the light quantity adjustment for the optical sensor is ended, it becomes possible for the image forming apparatus to normally function. Note that the display unit of the image forming apparatus does not change from a default screen shown in FIG. 7B.

On the other hand, if a "NO" result is obtained in step S2304, the processing proceeds to step S2307. A state, for which the "NO" result is obtained in step S2304, will be concretely described with reference to FIG. 8. It is assumed that when the light quantity of the optical sensor is decreased from "C" to "D" as shown in FIG. 8, the light quantity adjustment is performed. A voltage VinN applied to the light emission element 2154 when the light quantity is "D" is VinBC and the output voltage VoutN obtained by converting the quantity of light received by the light reception element 2155 is Vout5. The voltage VinDE to be applied to the light emission element 2154 for compensating only for the decreasing amount of the light quantity of the optical sensor is obtained by "VinDE=VM/Vout5×VinBC" as a result of the light quantity adjustment at "D". The obtained voltage VinDE has a relation of VinDE>VinMAX, so that the processing proceeds to step S2307.

In step S2307, the obtained voltage exceeds VinMAX, so that VinMAX that is applicable to the light emission element 2154 is set as a voltage value for controlling the light quantity of the optical sensor and there is obtained a light quantity corresponding to VinMAX. Even with a light amount obtained by setting VinMAX, if the light amount satisfies a certain condition, it is possible to use an optical sensor to perform sheet detection. However, if a voltage obtained by converting the quantity of light received by the light reception element 2155 of the optical sensor becomes equal to or lower than a threshold voltage (VS), it becomes impossible to judge the presence or absence of a sheet. If falling into this state, the image forming apparatus becomes inoperable.

In step S2310, when a voltage for controlling the quantity of light of the optical sensor is VinMAX, the microcomputer 2108 judges whether an output voltage obtained by converting the quantity of light received by the light reception element 2155 is equal to or lower than a predetermined output voltage. The predetermined output voltage is set for the microcomputer 2108. For instance, the predetermined output voltage is Vh shown in FIG. 8 and is a value between VM and VS. This value indicates that the optical sensor is placed in a state where there is a high probability that it becomes impossible to detect the presence or absence of a sheet. The value of Vh in step S2310 is an arbitrary value and it is also possible to set this value at VM. In this case, it is meant that step S2310 will be omitted.

Figure 7A:
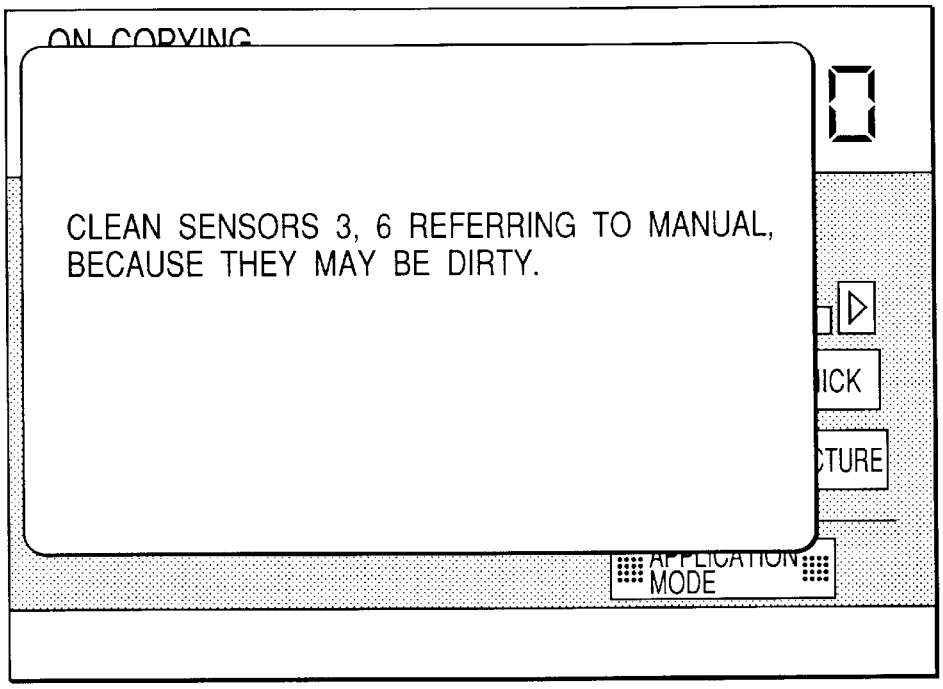
FIGS. 7A and 7B are each a drawing showing the display unit of the operation unit of the image forming apparatus.
Figure 7B:
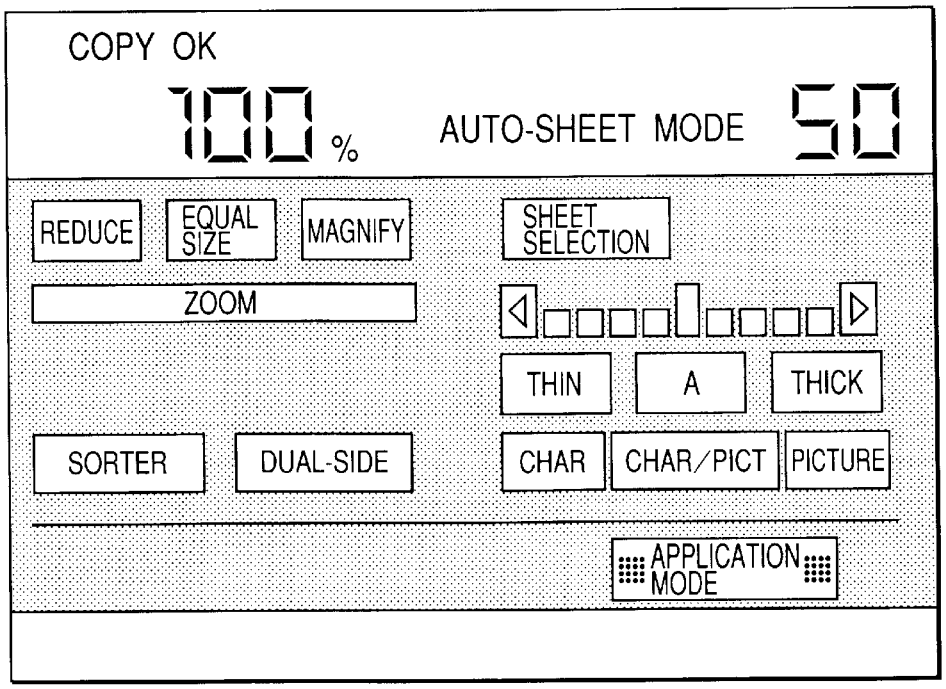

If a "NO" result is obtained in step S2310, the light quantity adjustment is ended (step S2306). After the light quantity adjustment is ended, the image forming apparatus becomes capable of performing ordinary operations. If a "YES" result is obtained in step S2310, a message "CLEANING REQUIRED" is displayed on the display unit of the image forming apparatus (step S2308). This message indicates that the image forming apparatus is placed in a state where it is possible to perform ordinary operations but there is a high probability that the optical sensor becomes incapable of performing sheet detection. FIG. 7A shows contents displayed in this case.

Figure 9:
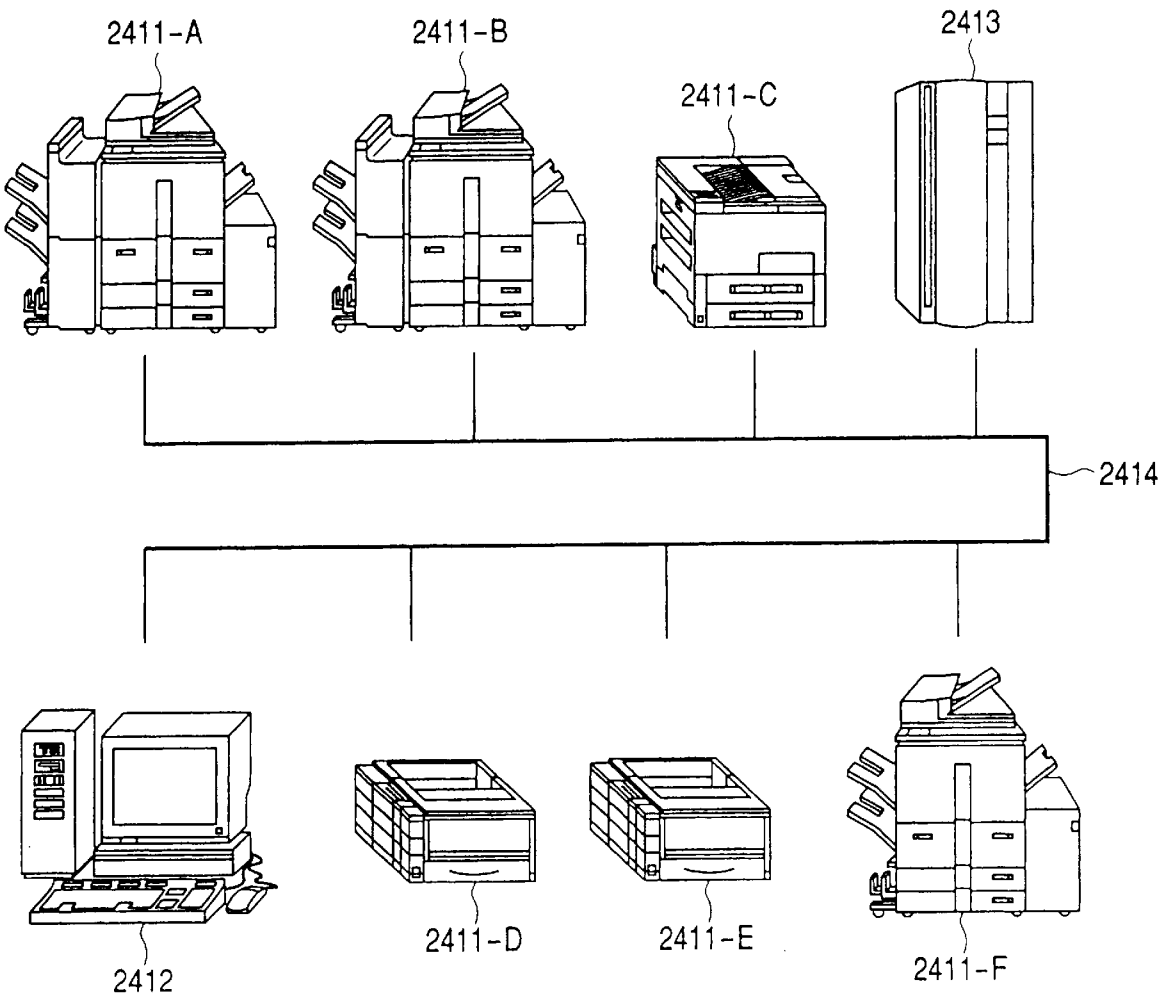
FIG. 9 is a construction drawing of a network to which image forming apparatuses are connected.

Further, in the case where the image forming apparatus is connected to a network, it is also possible to send notification to a serviceman or an administrator. FIG. 9 is a construction drawing where image forming apparatuses are connected onto a network. Reference numerals 2411-A, 2411-B, 2411-C, 2411-D, 2411-E, and 2411-F each denote an image forming apparatus, numeral 2412 denotes a host computer (serviceman or administrator), and numeral 2413 denotes a network server. Reference numeral 2414 represents a network and indicates means for sending information such as a LAN, the Internet, or a telephone line. Network cards or modems (not shown) are used to connect the image forming apparatuses 2411 to the network 2414.

In step S2309, in accordance with a result of the light quantity adjustment for an optical sensor, the image forming apparatus 2411 notifies the host computer 2412 of the value of a voltage to be applied to the light emission portion of the optical sensor, an output voltage value, or the like. As a result of this operation, it becomes possible to request the serviceman or administrator to perform maintenance work for the image forming apparatus 2411 and to prevent the image forming apparatus 2411 from becoming unusable. After a warning is displayed on the display unit or a notification is sent to the host computer 2412, the processing proceeds to step S2306 in which the light quantity adjustment is ended. After the light quantity adjustment is ended, the image forming apparatus is placed in a state where it is possible to perform ordinary operations but there is a high probability that it becomes impossible for the optical sensor to perform sheet detection. Note that it is possible to omit step S2309 when the image forming apparatus 2411 is not connected to the network 2414.

Next, there will be described how an image forming apparatus operates in the case where the sheet detection remains impossible even after the light quantity adjustment is performed for its optical sensor or in the case where the sheet detection is unstable. The following description will be made with reference to the flowchart in FIG. 10, the driver circuit diagram of the optical sensor in FIG. 2, and the Vin-Vout characteristic curve in FIGS. 3A or 3B. First, there will be described a case where the adjustment is performed when the image forming apparatus is produced or when an optical sensor is installed or replaced. The light quantity adjustment is started in accordance with the turning on of the power source of the image forming apparatus from the operation unit (step S2501). In step S2512, it is judged whether an alarm flag is set for an optical sensor that is a target. The alarm flag is set in step S2508 in the case where a predetermined output value is not obtained during the light quantity adjustment. If the alarm flag is not set, the counter N is set at "1" in step S2513.

In step S2502, a predetermined digital signal corresponding to Vin1 is outputted from the microcomputer 2108, thereby causing the LED 2154 to emit light. In step S2503, the quantity of light received by a phototransistor 2155 is converted into a voltage value and the microcomputer 2108 reads this value. The microcomputer 2108 is connected to a RAM 2503 and, if Vin1 does not reach VM, an input voltage value is stored in the RAM 2503 in step S2504.

A value "1" is added to the counter N in step S2505 and it is judged in step S2506 whether output/input operations have been performed ten times that is the number of repetition as preset. In this embodiment, the number of repetition is set at ten before there is obtained Vin10 as shown in FIG. 3A. However, the number of repetition is obtained by dividing a signal outputted from the microcomputer 2108 within a certain range in advance and it is also possible to set the number of divisions, that is, the number of repetition at a value other than ten. Note that although the accuracy is improved in accordance with the increase of the number of repetition, a time consumed is elongated.

Also, Vin10 is the maximum value that is allowable in view of mechanical specifications and this value is set so as not to exceed VinMAX in accordance with the specifications. Here, it is assumed that Vin10=VinMAX and the following description will be made on the basis of this assumption.

If it is not judged that the output/input operations have been performed ten times in step S2506, the processing returns to step S2502 again and a predetermined digital signal is outputted from the microcomputer 2108. In this case, there is inputted Vin2 obtained by increasing Vin1 previously inputted by a predetermined amount. That is, a voltage is applied so as to maintain a relation of Vin(N+1) >VinN. In this embodiment, the signal is divided into ten ranges and input operations are performed by performing switching from the minimum value Vin1 to the maximum value Vin10 in stages.

If the routine from step S2502 to step S2506 has been repeated ten times, the processing proceeds to step S2507 in which it is judged whether the output voltage reaches a preset voltage value. The preset voltage value described here means the maximum value VM of Vout, and with the valve VM there is received irradiation light with which it is sufficiently possible to recognize the presence or absence of a sheet. If it is judged that Vout10 reaches the preset voltage value in step S2507, there is obtained an "OK" judgment. In step S2509, the lowest of Vin values obtained when a changing amount is zero in Vout1 to Vout10 is set as a control value and the adjustment is ended. In FIG. 3A, at a point in time when Vin8 is inputted, the output voltage reaches a saturation voltage VM. Even if the application voltage exceeds Vin8, an output voltage remains as VM (the changing amount is zero), so that there is applied Vin8 that is the minimum voltage required to obtain the voltage VM.

On the other hand, there will be described a case shown in FIG. 3B where the output voltage does not reach the preset voltage value VM. This case corresponds to a case where it is not judged that Vout10 reaches VM in step S2507. Consequently, the alarm flag is set in step S2508 and it is judged whether Vout10 exceeds the preset VS in step S2511. VS is a threshold value that is a limit value with which it is possible to recognize the presence or absence of a sheet or a value obtained by adding a slight margin to the threshold value. Therefore, if the voltage is equal to or lower than VS, there occurs a malfunction of the optical sensor or there tends to occur such a malfunction. If it is judged that the voltage is equal to or lower than VS in step S2508, the processing proceeds to step S2515. Also, if the voltage exceeds VS, that is, if VS<Vout10<VM, the output of the optical sensor remains within a range in which it is possible to recognize the presence or absence of a sheet. Consequently, the processing proceeds to step S2510 and the light quantity adjustment is ended.

In the case where it is judged that Vout10 is equal to or lower than VS in step S2511, this means that it is judged that the output is reduced to VS or lower in step S2508 regardless of a fact that the output is equal to or higher than VM during the previous adjustment and the alarm flag was not set in step S2512. As a result, it is conceived that an abnormality occurred to the optical sensor. As a result, a notification is sent to a user or a serviceman.

If the alarm flag is set in step S2508, it is judged that the alarm flag is set in step S2512 during the light quantity adjustment performed when the power source is turned on next time, so that the processing proceeds to step S2514. If it is judged that Vout10 exceeds VS in step S2514, that is, it is judged as VS<Vout10<VM, the adjustment is ended. In the case where it is judged that the voltage is equal to or lower than VS, the processing proceeds to step S2515. In this case, it is meant that the output is further reduced from the state for which the alarm flag was set during the previous adjustment.

In step S2515, the access to the optical sensor is inhibited and the setting of a mode pertinent to this optical sensor is invalidated in step S2516 and there is imposed a limitation on the setting of the operation mode through the display unit of the operation unit 2501. This will be described in detail later.

The control described above is the light quantity adjustment for the optical sensor that is automatically started in response to the turning on of the power source of the image forming apparatus. However, it is possible for a serviceman to have the optical sensor light quantity adjustment performed by performing a predetermined operation through the operation unit 2501. For instance, it becomes possible for the serviceman to have the light quantity adjustment performed when he/she replaces defective sensors. If the serviceman starts the light quantity adjustment by operating the operation unit 2501 in step S2517, the alarm flag is reset in step S2518 and then the processing proceeds to step S2513.

Figure 10:
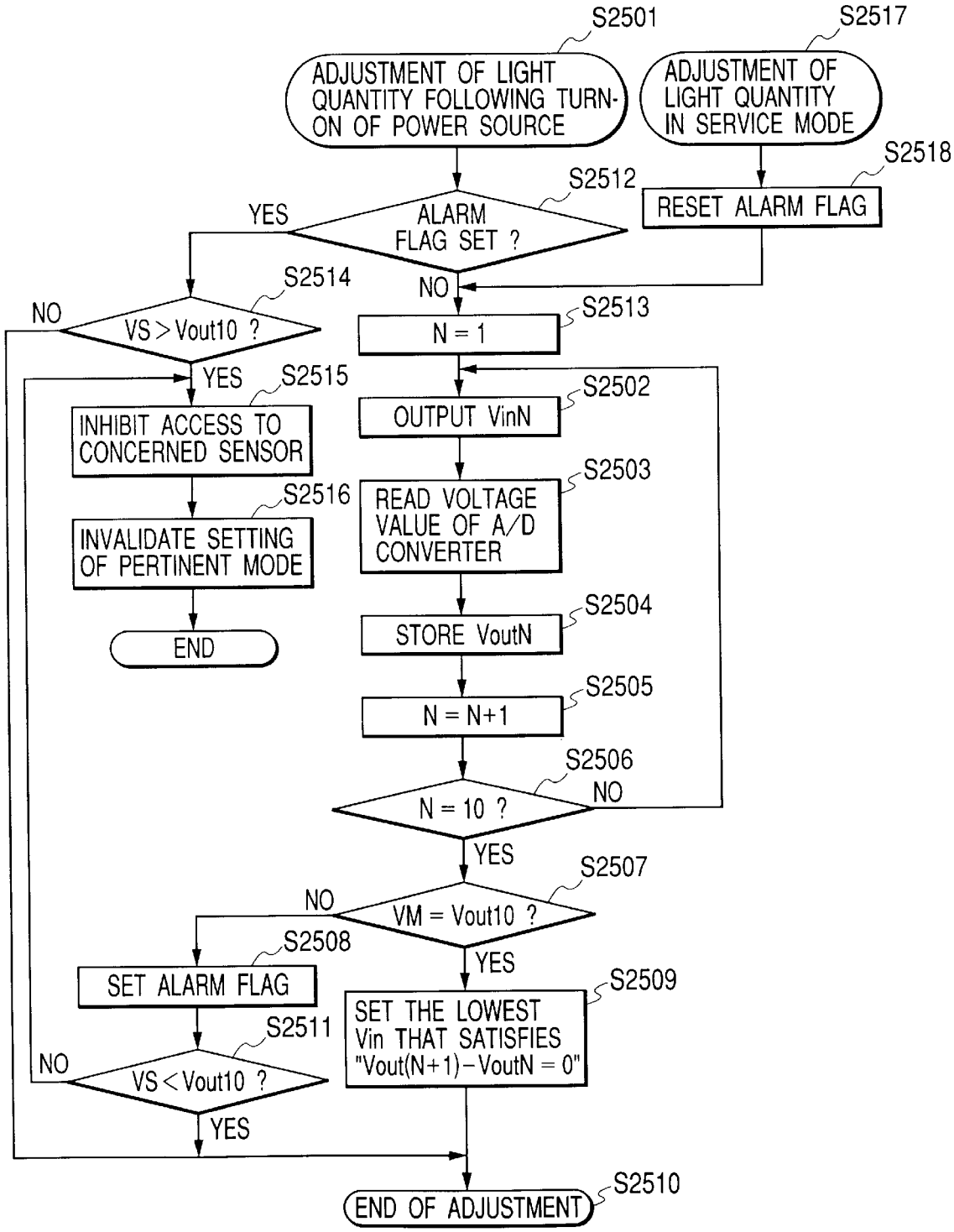
FIG. 10 is a flowchart for performing light quantity adjustment for a sheet detecting unit in the image forming apparatus.
Figure 11:
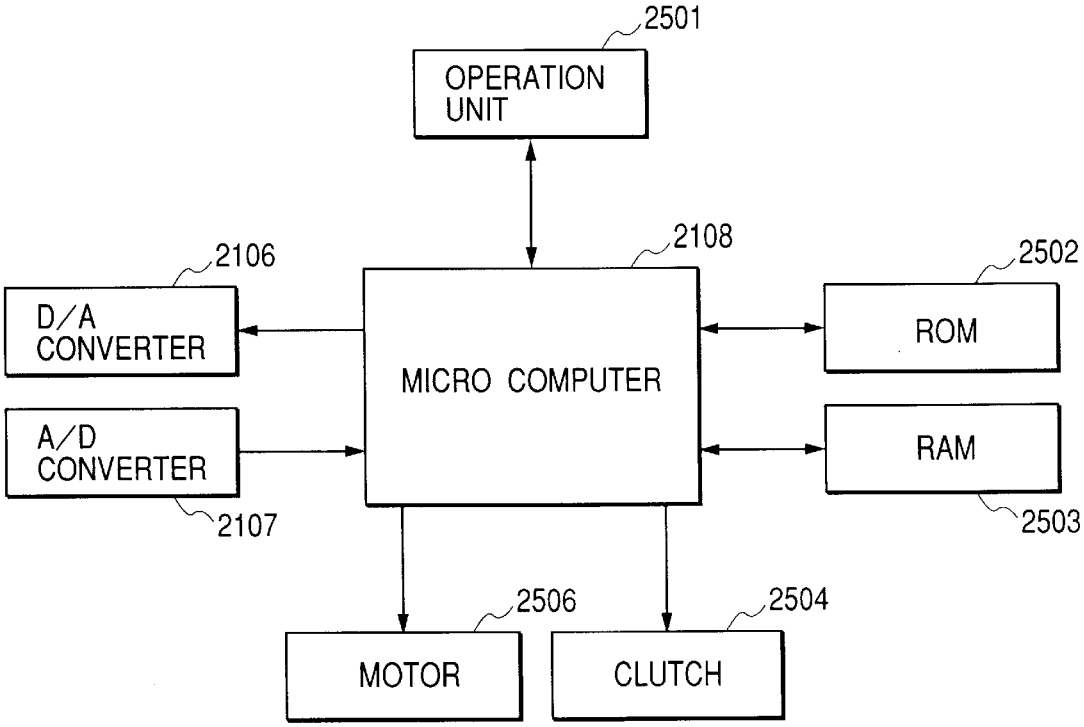
FIG. 11 is a control block diagram of the image forming apparatus.

FIG. 11 is a control block diagram of the present image forming apparatus. The microcomputer 2108 performs the control of the image forming apparatus in accordance with a program stored in the ROM 2502. A program for performing a flowchart in FIG. 10 is also stored in the ROM 2502 and is executed by the microcomputer 2108. The RAM 2503 stores data that is required to carry out processing by the microcomputer 2108 and stores Vout1 to Vout10, which is obtained when the flowchart in FIG. 10 is performed, or the like. A motor 2506 and a clutch 2504 drive each component within the image forming apparatus and are controlled by the microcomputer 2108. Each user's instructions inputted using keys or a touch panel of the operation unit 2501 are inputted into the microcomputer 2108 and the screen displayed on the operation unit 2501 is controlled by the microcomputer 2108 in accordance with the program stored in the ROM 2503.

Figure 12A:
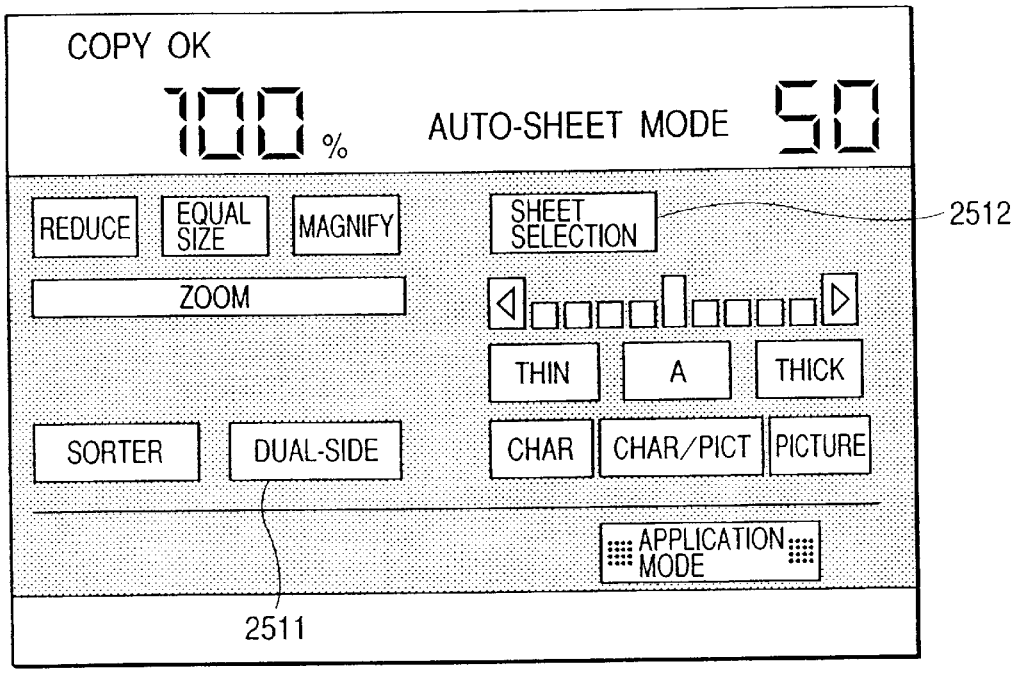
FIGS. 12A and 12B are each a drawing showing the display unit of the operation unit of the image forming apparatus.

FIG. 12A is a drawing showing the display unit of the operation unit 2501 of the image forming apparatus. There will be described display control that will be performed when it is judged that an output is lower than VS in step S2014 in FIG. 10 during the adjustment of an optical sensor 131 shown in FIG. 1, that is, it is judged that the optical sensor 131 suffers from an abnormality, paper powder is accumulated on the optical sensor 131, or the optical sensor 131 becomes dirty due to toner or the like. If a dual-side copying mode is set, each sheet passes through a conveying path 125. On the other hand, if the dual-side copying mode is not set, each sheet does not pass through the conveying path 125. That is, the sensor 131 for detecting each sheet passing through the conveying path 125 is not required in modes other than the dual-side copying mode.

Figure 12B:
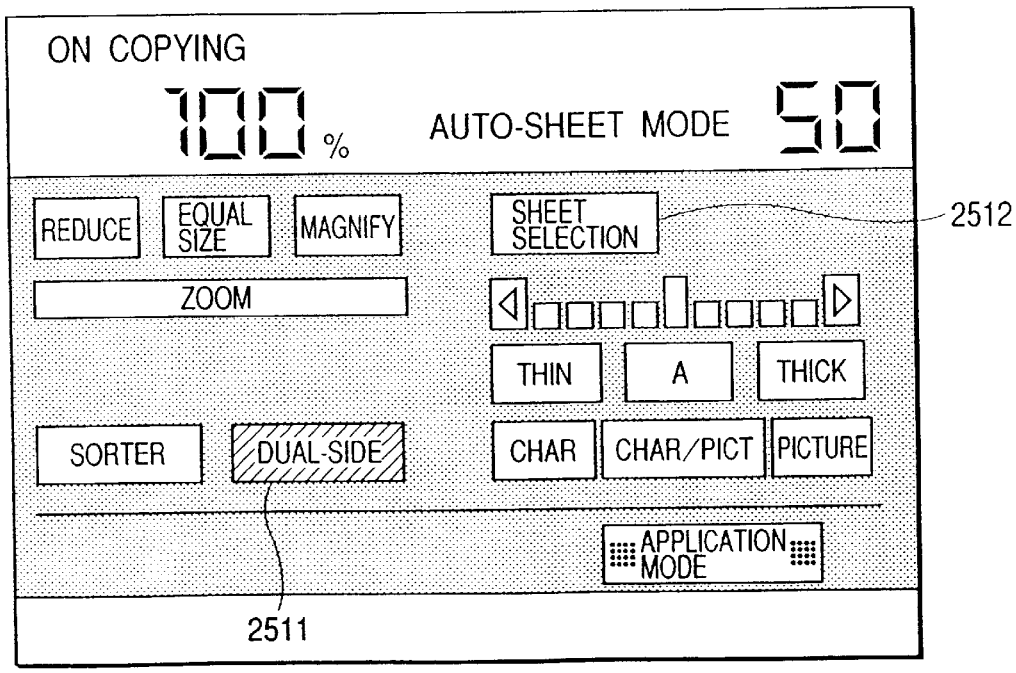

Accordingly, in the case where it is judged that Vout10 is lower than VS in step S2514, a dual-side copying key 2511 is displayed under a hatched state as shown in FIG. 12B, and a key input is inhibited even if the duplex copying key 2511 is pushed. In this manner, there is prevented the selection of the duplex copying mode. That is, a display operation is performed so that each item, whose setting is inhibited, is distinguished from each item that can be set, and setting is not received even if a portion corresponding to an item, whose setting is inhibited, is pushed. By doing so, there is prevented a situation where there is inhibited the use of all functions of the image forming apparatus. That is, the use of only the duplex copying mode is limited, so that when the optical sensor 131 suffers from an abnormality or when paper powder or toner is accumulated on the optical sensor 131, it becomes possible to circumvent a situation where it becomes completely impossible for a user to use the image forming apparatus. Accordingly, it becomes possible to use the image forming apparatus without stopping the apparatus even before a serviceman arrives.

Also, with a construction where it is possible for a user to easily clean the optical sensor 131, if the user turns on the image forming apparatus after removing paper powder accumulated on the optical sensor 131, the output voltage becomes equal to or higher than VS in step S2514 during the light quantity adjustment for the optical sensor 131 that is started in response to the turning on of a power source. Consequently, the processing proceeds to step S2510 in which the adjustment is ended, so that the image forming apparatus automatically returns to a normal state.

Figure 13:
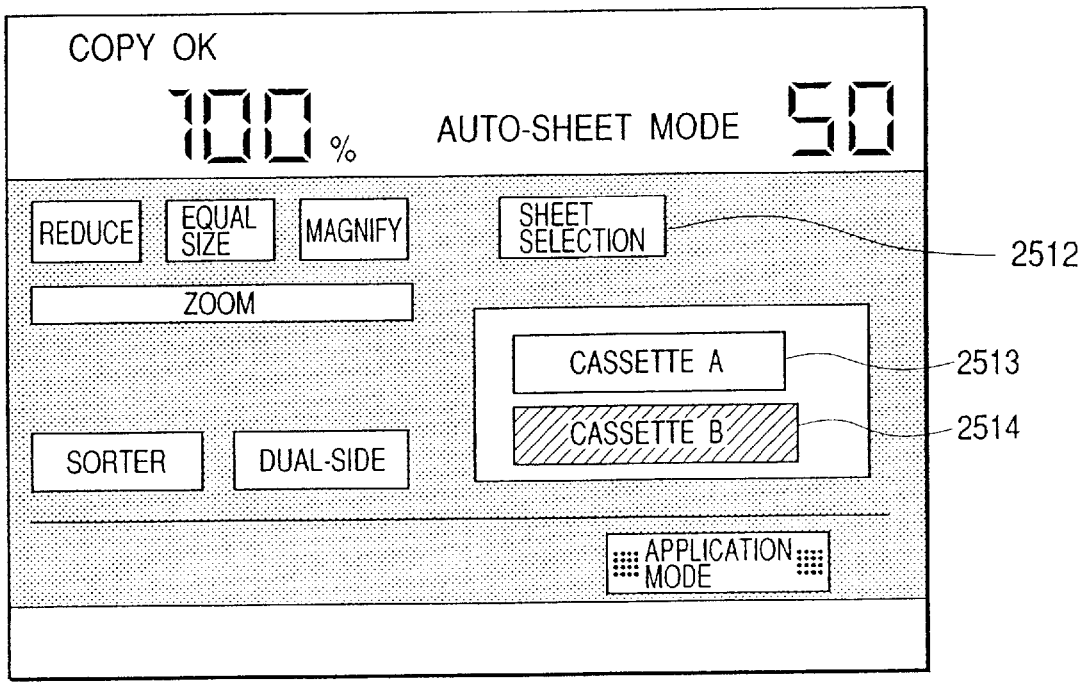
FIG. 13 is a drawing showing the display unit of the operation unit of the image forming apparatus.

FIG. 13 is a drawing showing a screen displayed in the case where a malfunction occurs to a sensor other than the optical sensor 131. There will be described display control to be performed in the case where it is judged that the output voltage is lower than VS in step S2514 in FIG. 10 during the adjustment of an optical sensor 126 or 127 in FIG. 1, that is, it is judged that the optical sensor 126 or 127 suffers from an abnormality, paper powder is accumulated on the optical sensor 126 or 127, or the optical sensor becomes dirty due to toner. When a sheet is to be fed from a cassette Y, the sheet passes over the optical sensor 126 and the sensor 127. However, when a sheet is fed from a cassette X, the sheet does not pass over the optical sensor 126 and the sensor 127. As a result, in the case where the input of sheet selection 2512 is performed as shown in FIG. 13, the indication of a cassette X key 2513 is unchanged, and a cassette Y key 2514 is hatched or the like and the key input is inhibited even if the cassette Y key 2514 is pushed. In this manner, there is prevented the selection of sheet feeding from the cassette Y. That is, display is performed so that each item, whose setting is prohibited, is distinguished from each item that can be set, and setting is not received even if a portion corresponding to an item, whose setting is prohibited, is pushed. By doing so, there is prevented a situation where there is inhibited the use of all functions of the image forming apparatus. That is, a limitation is imposed so that only the sheet feeding from the cassette Y becomes unusable. As a result, when the optical sensor 126 or 127 suffers from an abnormality or when paper powder is accumulated on the optical sensor 126 or 127, it becomes possible to circumvent a situation where it becomes completely impossible for a user to use the image forming apparatus. Accordingly, it is possible to use the image forming apparatus without stopping the apparatus even before a serviceman arrives.

Also, with a construction where it is possible for a user to easily clean the optical sensors 126 and 127, when the user turns on the power source after removing paper powder accumulated on the optical sensors 126 and 127, the output voltage becomes equal to or higher than VS in step S2514 during the light quantity adjustment for the optical sensors 126 and 127 that is started in response to the turning on of the power source. Consequently, the processing proceeds to step S2510 in which the adjustment is ended, so that the image forming apparatus automatically returns to a normal state.

Next, there will be described the adjustment performed in a short time between image forming jobs or the like, that is, the case of a simple adjustment mode that is simplified in comparison with the adjustment performed when the image forming apparatus is produced or the optical sensor is installed or replaced. The construction and circuit are the same as those used for the adjustment performed when the image forming apparatus is produced or the optical sensor is installed or replaced. The following description will be made with reference to the flowchart in FIG. 14 and the Vin-Vout characteristic curve in FIG. 8.

Figure 14:
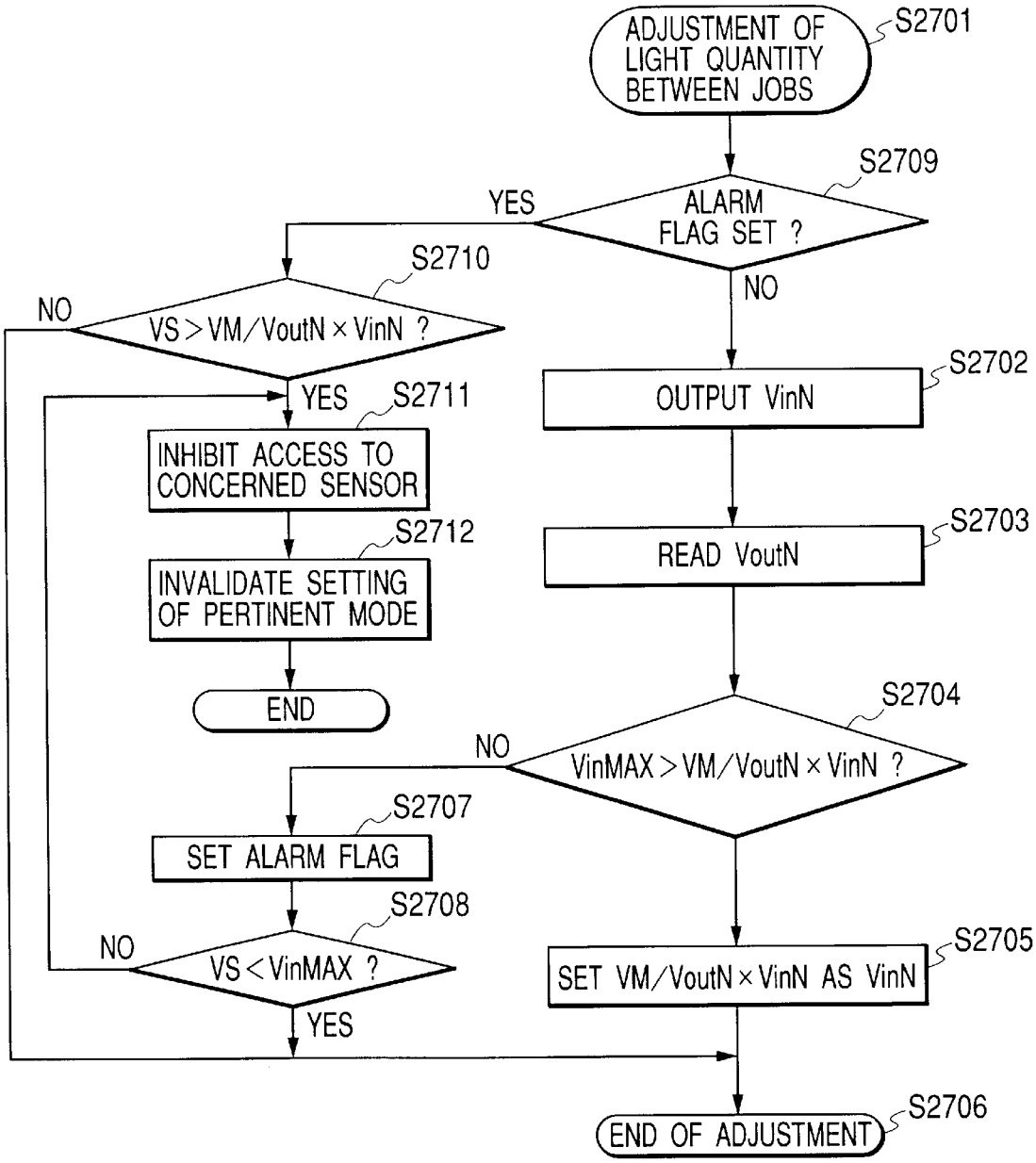
FIG. 14 is a flowchart for performing light quantity adjustment for the sheet detecting unit in the image forming apparatus.
Figure 15:
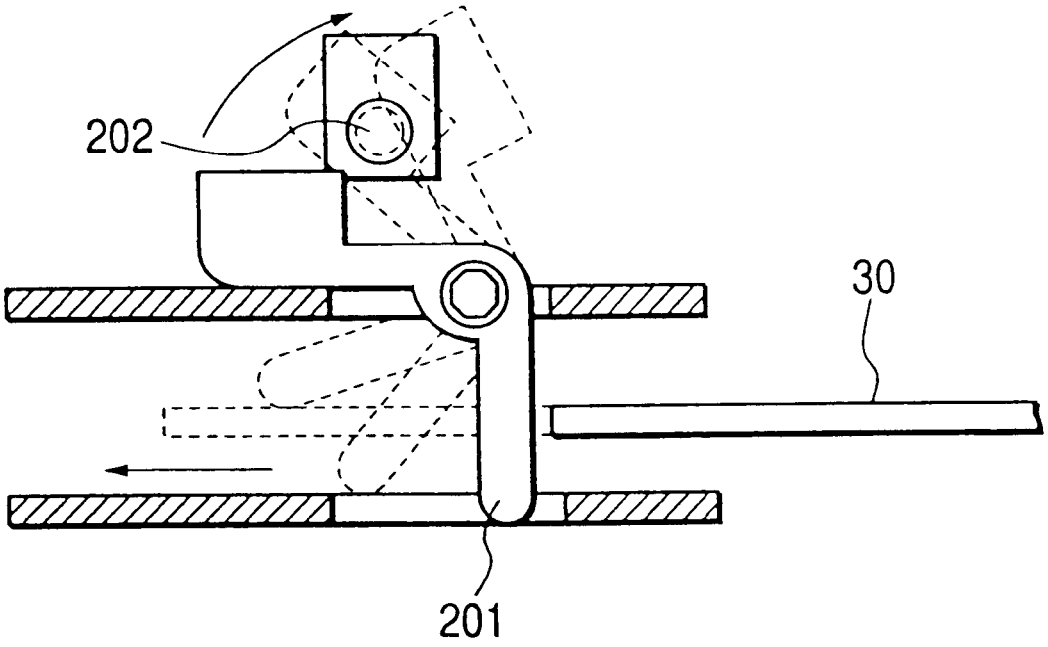
FIG. 15 is a construction drawing of a sensor based on a mechanical sheet detecting method.
Figure 16A:
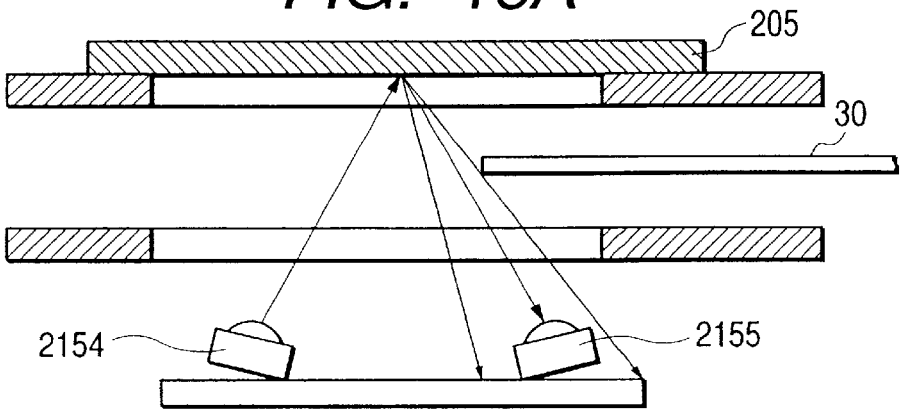
FIGS. 16A and 16B are each a construction drawing of a reflection type optical sensor.
Figure 16B:
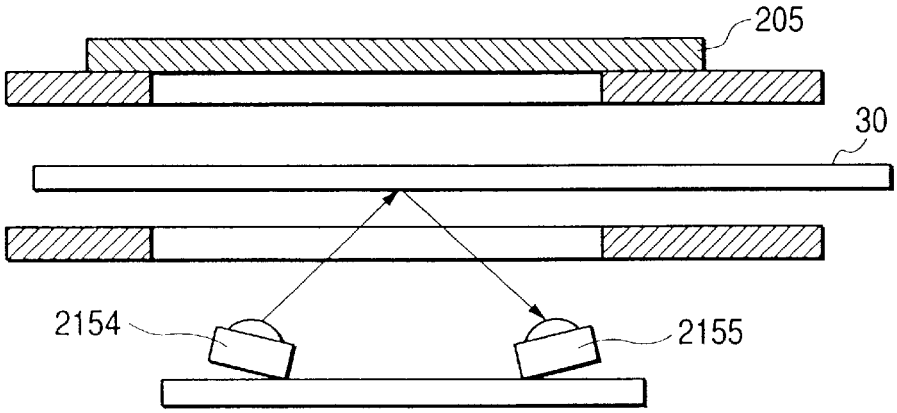
Figure 17:
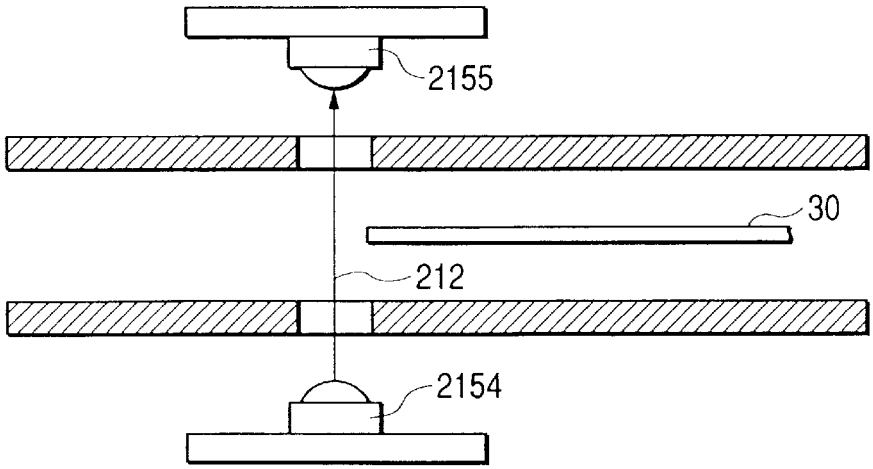
FIG. 17 is a construction drawing of a transmission type optical sensor.

The flowchart in FIG. 14 will be described below using the Vin-Vout characteristic curve in FIG. 8. In step S2701, the light quantity adjustment is started immediately after the image forming apparatus ends an image forming job. That is, the operation shown in the flowchart of FIG. 14 is performed between an image forming job and another image forming job. In step S2709, it is judged whether the alarm flag is set for an optical sensor that is a target. The alarm flag is set in step S2708 in the case where a predetermined output value is not obtained during the light quantity adjustment. If the alarm flag is not set, the output VoutN is obtained by inputting VinN into the optical sensor in step S2702. VinN assumes a value set during the previous adjustment. Assuming that the adjustment is performed at the B point in FIG. 8, Vin8 is inputted and the output Vout5 is read in step S2703. Because the light quantity is reduced, the input application voltage is increased with a ratio corresponding to a reduction degree. The input application voltage required to obtain VM becomes "VM/Vout×VinN". Consequently, when this calculation is applied to the B point in FIG. 8, there is obtained a result of "VM/Vout5×Vin8=VinBC". As a result, a relation of "VinMAX>Vin (VinBC)" is obtained in step S2704, so that the input application voltage value is set at VinBC in step S2705. The voltage value is set at the C point in FIG. 8, so that the adjustment is ended in step S2706.

Next, as to the adjustment performed in the case where the voltage value moves up to the D point due to the stains resulting from paper powder, toner, or the like, if this case is applied to the formula described above, there is obtained an equation of "VM/Vout5×VinBC=VinDE", so that there is obtained a relation of "Vin(VinDE)>VinMAX". In this case, there is obtained a relation of "VinMAX<VM/VoutN×VinN (=VinDE)" in step S2704, so that the processing proceeds to step S2707 in which the alarm flag is set. In step S2708, it is judged whether the output VoutMAX, which is obtained when VinMAX is inputted, exceeds VS. VS is a threshold value that is a limit value with which it is possible to recognize the presence or absence of a sheet or a value obtained by adding a slight margin to this threshold value. Therefore, if the output voltage is equal to or lower than VS, there occurs a malfunction of the optical sensor or there tends to occur such a malfunction. If it is judged that the output voltage exceeds VS in step S2708, that is, if VS<Vout10<VM, the processing proceeds to step S2706 and the adjustment is ended.

In the case where it is judged that the output voltage is equal to or lower than VS at the F point in FIG. 8 in step S2708, the output is reduced to VS or lower in step S2708 regardless of a fact that the output is equal to or higher than VM during the previous adjustment and the alarm flag was not set in step S2709. As a result, it is conceived that any abnormality occurs to the optical sensor, so that a notification is sent to a user or a serviceman.

If the alarm flag is set in step S2707, it is judged that the alarm flag is set in step S2709 during the light quantity adjustment performed before the next image forming job, so that the processing proceeds to step S2710. If it is judged that VM/VoutN×VinN exceeds VS in step 710, that is, if there is obtained a relation of "VS<Vout10<VM", the adjustment is ended. In the case where it is judged that the output voltage does not exceed VS, the processing proceeds to step S2711. In this case, the output is further reduced from the state in which the alarm flag is set at the E point in FIG. 8 during the previous adjustment. Consequently, it is conceived that there occurs no sudden abnormality or the like but the output reduction is caused by degradation over time due to stains resulting from paper powder or the like.

The access to the optical sensor is inhibited in step S2711 and the setting of a mode related to this optical sensor is invalidated in step S2712 and there is imposed a limitation on the setting of operation modes through the display unit of the operation unit 2501. These operations are the same as those described with reference to FIGS. 12A, 12B, and 13.

The image forming apparatus in the embodiment described above is a copying machine, although the present invention is not limited to this. That is, the present invention may be applied to an electrophotographic printer, an ink-jet printer, or a transfer-type printer.

What is claimed is:

1. A sheet detecting apparatus comprising:

an optical sensor including a light emission portion and a light reception portion;

judging means for judging the presence or absence of a sheet by applying a voltage to the light emission portion;

adjusting means for adjusting the voltage to be applied to the light emission portion in order to make the judgment, and calculating means for obtaining the voltage to be applied to the light emission portion at the adjusting means through calculation.

2. A sheet detecting apparatus according to claim 1, wherein when adjusting the voltage to be applied to the light emission portion, the calculating means obtains the voltage to be applied to the light emission portion through calculation based on a relation between a voltage applied to the light emission portion before the adjustment and an output obtained through reception of light from the light emission portion by the light reception portion before the adjustment.

3. A sheet detecting apparatus according to claim 2, wherein when adjusting the voltage to be applied to the light emission portion, the calculating means calculates a proportional coefficient based on the voltage applied to the light emission portion before the adjustment and the output obtained through the reception of the light from the light emission portion by the light reception portion before the adjustment, and obtains a voltage, with by which a desired output can be obtained at the light reception portion, based on the proportional coefficient.

4. A sheet detecting apparatus according to claim 2, wherein a state of the optical sensor is displayed in accordance with a fact that the voltage obtained by the calculating means is equal to or higher than the maximum value of a voltage applicable to the light emission portion.

5. A sheet detecting apparatus according to claim 2, wherein when the voltage obtained by the calculating means is equal to or higher than the maximum value of a voltage applicable to the light emission portion and an output of the light reception portion is lower than a predetermined value, there is displayed a state of the optical sensor.

6. A sheet detecting apparatus according to claim 2 further comprising communication means for communicating with an external apparatus, wherein a notification is sent to the external apparatus through the communication means in accordance with a fact that the voltage obtained by the calculating means is at least equal to the maximum value of a voltage applicable to the light emission portion.

7. A sheet detecting apparatus according to claim 2 further comprising communication means for communicating with an external apparatus, wherein a notification is sent to the external apparatus through the communication means when the voltage obtained by the calculating means is equal to higher than the maximum value of a voltage applicable to the light emission portion and an output of the light reception portion is lower than a predetermined value.

8. A sheet detecting apparatus according to claim 2, wherein when the voltage obtained by the calculating means is equal to or higher than the maximum value of a voltage applicable to the light emission portion, the voltage to be applied to the light emission portion is set at the maximum value of the applicable voltage.

9. A sheet detecting apparatus according to claim 2, wherein the adjusting means includes first means for adjusting the voltage to be applied to the light emission portion based on the calculating means, and second means for adjusting the voltage to be applied to the light emission portion in accordance with a fact that a predetermined condition is satisfied by an output obtained through reception of light emitted by the light emission portion through gradual application of a voltage, by means of the light reception portion.

10. An image forming apparatus comprising:

a conveying path for conveying a sheet;

an optical sensor including a light emission portion and a light reception portion, for detecting a sheet passing through the sheet conveying path;

judging means for judging the presence or absence of a sheet by applying a voltage to the light emission portion;

adjusting means for adjusting the voltage to be applied to the light emission portion in order to make the judgment;

calculating means for obtaining the voltage to be adjusted by the adjusting means through calculation; and control means for controlling conveyance of a sheet by applying the voltage obtained by the calculating means to the light emission portion and by detecting the sheet.

11. An image forming apparatus according to claim 10, wherein when adjusting the voltage to be applied to the light emission portion, the calculating means obtains the voltage to be applied to the light emission portion through calculation based on a relation between a voltage applied to the light emission portion before the adjustment and an output obtained through reception of light from the light emission portion by the light reception portion before the adjustment.

12. An image forming apparatus according to claim 11, wherein when adjusting the voltage to be applied to the light emission portion, the calculating means calculates a proportional coefficient based on the voltage applied to the light emission portion before the adjustment and the output obtained through the reception of the light from the light emission portion by the light reception portion before the adjustment, and obtains a voltage, by which a desired output can be obtained at the light reception portion, based on the proportional coefficient.

13. An image forming apparatus according to claim 11, wherein a state of the optical sensor is displayed in accordance with a fact that the voltage obtained by the calculating means is equal to or higher than the maximum value of a voltage applicable to the light emission portion.

14. An image forming apparatus according to claim 11, wherein when the voltage obtained by the calculating means is equal to or higher than the maximum value of a voltage applicable to the light emission portion and an output of the light reception portion is lower than a predetermined value, there is displayed a state of the optical sensor.

15. An image forming apparatus according to claim 11 further comprising communication means for communicating with an external apparatus, wherein a notification is sent to the external apparatus through the communication means in accordance with a fact that the voltage obtained by the calculating means is equal to or higher than the maximum value of a voltage applicable to the light emission portion.

16. An image forming apparatus according to claim 11 further comprising communication means for communicating with an external apparatus, wherein a notification is sent to the external apparatus through the communication means when the voltage obtained by the calculating means is at least equal to the maximum value of a voltage applicable to the light emission portion and an output of the light reception portion is lower than a predetermined value.

17. An image forming apparatus according to claim 11, wherein when the voltage obtained by the calculating means is equal to or higher than the maximum value of a voltage applicable to the light emission portion, the voltage to be applied to the light emission portion is set at the maximum value of the applicable voltage.

18. An image forming apparatus according to claim 11, wherein if an output from the light reception portion through the application of the voltage obtained by the calculating means to the light emission portion is equal to or lower than a predetermined value, it is judged that the optical sensor suffers from an abnormality and there is inhibited setting involving use of the sheet conveying path, in which the optical sensor is provided, without inhibiting use of the whole of the image forming apparatus.

19. An image forming apparatus according to claim 18, wherein an item, whose setting for usage is inhibited, is displayed so as to be distinguishable from each item whose setting is possible, and setting is not received even if a portion corresponding to the item, whose setting is inhibited, is pushed.

20. An image forming apparatus according to claim 11, wherein the adjusting means includes first means for adjusting the voltage to be applied to the light emission portion based on the calculating means, and second means for adjusting the voltage to be applied to the light emission portion in accordance with a fact that a predetermined condition is satisfied by an output obtained through reception of light emitted by the light emission portion emit light through gradual application of a voltage, by means of the light reception portion.

* * * * *

UNITED STATES PATENT AND TRADEMARK OFFICE

CERTIFICATE OF CORRECTION

PATENT NO. : 6,704,523 B2
DATED : March 9, 2004
INVENTOR(S) : Ikuo Takeuchi et al.

It is certified that error appears in the above-identified patent and that said Letters Patent is hereby corrected as shown below:

Drawings,
Delete Figure 13, and substitute therefor Figure 13, as shown on the attached page:

Column 2,
Line 11, "of absence" should read -- or absence --.

Column 15,
Line 6, "inputted" should read -- input --.

Signed and Sealed this

Twenty-fourth Day of August, 2004

JON W. DUDAS
*Director of the United States Patent and Trademark Office*